US009258850B2

(12) United States Patent
Yoshikado et al.

(10) Patent No.: US 9,258,850 B2
(45) Date of Patent: Feb. 9, 2016

(54) MICROWAVE HEATING DEVICE AND IMAGE FIXING APPARATUS USING THE SAME

(71) Applicants: MURATA MACHINERY, LTD., Kyoto-shi, Kyoto (JP); THE DOSHISHA, Kyoto-shi, Kyoto (JP)

(72) Inventors: Shinzo Yoshikado, Kyotanabe (JP); Yoshihiro Shojo, Kyoto (JP); Isao Fukuda, Kyoto (JP)

(73) Assignees: MURATA MACHINERY, LTD., Kyoto (JP); THE DOSHISHA, Kyoto (JP)

( * ) Notice: Subject to any disclaimer, the term of this patent is extended or adjusted under 35 U.S.C. 154(b) by 578 days.

(21) Appl. No.: 13/686,668

(22) Filed: Nov. 27, 2012

(65) Prior Publication Data

US 2013/0134155 A1 May 30, 2013

(30) Foreign Application Priority Data

Nov. 28, 2011 (JP) ..... 2011-258579

(51) Int. Cl.

| | |
|---|---|
| ***H05B 6/64*** | (2006.01) |
| ***H05B 6/70*** | (2006.01) |
| ***H05B 6/74*** | (2006.01) |
| ***H05B 6/78*** | (2006.01) |

(52) U.S. Cl.

CPC ..... *H05B 6/6402* (2013.01); *H05B 6/701* (2013.01); *H05B 6/74* (2013.01); *H05B 6/78* (2013.01)

(58) Field of Classification Search

CPC ..... H05B 6/6402; H05B 6/78; H05B 6/74; H05B 6/701

USPC ..... 219/678, 693, 694, 696, 697; 399/45, 399/251, 336; 607/154

See application file for complete search history.

(56) References Cited

U.S. PATENT DOCUMENTS

| | | | | | |
|---|---|---|---|---|---|
| 3,739,130 | A | * | 6/1973 | White | 219/696 |
| 3,761,665 | A | * | 9/1973 | Nagao et al. | 219/694 |
| 3,783,221 | A | * | 1/1974 | Soulier | 219/693 |
| 4,093,840 | A | * | 6/1978 | Jean et al. | 219/697 |
| 4,099,042 | A | * | 7/1978 | Jean et al. | 219/696 |
| 4,108,147 | A | * | 8/1978 | Kantor | 607/156 |
| 4,275,283 | A | * | 6/1981 | Focht | 219/696 |

(Continued)

FOREIGN PATENT DOCUMENTS

| | | | |
|---|---|---|---|
| JP | 2003-295692 | A | 10/2003 |
| JP | 2003295692 | A | 10/2003 |

(Continued)

*Primary Examiner* — Thien S Tran

(74) *Attorney, Agent, or Firm* — DLA Piper LLP (US)

(57) ABSTRACT

A heating chamber is divided into a plurality of spaces by barrier sections including a conductive material. Phase shifters having different lengths with respect to a direction and including a dielectric body having permittivity higher than air are inserted in positions of a terminal section, in the spaces except for at least one space, to differentiate positions of bottoms of standing microwaves formed in the respective spaces from each other with respect to the direction. In addition, impedance adjusters having different lengths with respect to the direction and including a dielectric body having permittivity higher than air are inserted in positions on an upstream side of a region passed by the object to be heated, in the spaces except for at least one space, to reduce differences in impedance of the spaces from an entrance of the heating chamber to the terminal section including the phase shifters.

18 Claims, 18 Drawing Sheets

(56) References Cited

U.S. PATENT DOCUMENTS

| | | | | |
|---|---|---|---|---|
| 4,589,424 | A * | 5/1986 | Vaguine | 607/154 |
| 5,278,375 | A * | 1/1994 | Berteaud et al. | 219/693 |
| 5,422,463 | A * | 6/1995 | Gooray et al. | 219/694 |
| 5,536,921 | A * | 7/1996 | Hedrick et al. | 219/693 |
| 5,631,685 | A * | 5/1997 | Gooray et al. | 347/102 |
| 6,259,077 | B1 * | 7/2001 | Drozd et al. | 219/693 |
| 6,683,287 | B2 * | 1/2004 | Behnke et al. | 219/678 |
| 7,127,206 | B2 * | 10/2006 | Morgenweck et al. | 399/336 |
| 7,298,994 | B2 * | 11/2007 | Morgenweck et al. | 399/251 |
| 2003/0013034 | A1 * | 1/2003 | Behnke et al. | 430/124 |
| 2004/0264987 | A1 * | 12/2004 | Behnke et al. | 399/45 |
| 2010/0302318 | A1 | 12/2010 | Onozawa et al. | |

FOREIGN PATENT DOCUMENTS

| | | | |
|---|---|---|---|
| JP | 2004334176 | A | 11/2004 |
| JP | 2010089351 | A | 4/2010 |

* cited by examiner

| WIDTH OF ELECTRIC FIELD TRANSFORMER [mm] | WAVELENGTH CONVERSION | FRONT-TO-BACK RATIO |
|---|---|---|
| 0 | 0 | 1 |
| 6 | 0.06 λ g' | 1.26 |
| 13 | 0.13 λ g' | 1.79 |
| 25 | 0.25 λ g' | 1.82 |
| 37 | 0.37 λ g' | 1.7 |
| 44 | 0.44 λ g' | 1.1 |
| 50 | 0.50 λ g' | 1 |

MICROWAVE HEATING DEVICE AND IMAGE FIXING APPARATUS USING THE SAME

CROSS REFERENCE TO RELATED APPLICATIONS

This application claims the benefit of priority under 35 USC 119 of Japanese application no. 2011-258579, filed on Nov. 28, 2011, which is incorporated herein by reference.

BACKGROUND OF THE INVENTION

1. Field of the Invention

The present invention relates to a microwave heating device with high heating efficiency. The present invention also relates to an image fixing apparatus which uses such microwave heating device with high heating efficiency for fusing developing particles (toner).

2. Description of the Related Art

An image fixing apparatus fuses a toner material onto a sheet (object to be printed) to fix an image onto a sheet. A conventional image fixing apparatus applies heat or pressure onto the sheet by means of a fusing roller to fuse toner onto the sheet.

However, in the conventional configuration, the fusing roller wears with time. As a method for solving such a problem, a non-contact type method for fusing toner with a microwave has been developed in recent years (for example, see JP-A-2003-295692).

FIGS. 16A and 16B are conceptual diagrams showing a configuration of a microwave device disclosed in JP-A-2003-295692.

As shown in FIG. 16A, a microwave device 100 includes a magnetron 110 generating a microwave, an input coupling converter 113 which input couples the microwave generated from the magnetron 110 to a resonator chamber 103, a water reservoir 111, and a circulator 112. Between the input coupling converter 113 and the resonator chamber 103, a coupling aperture 114 with a diaphragm is provided. The resonator chamber 103 has a side surface 109 provided with a passing portion 107 for passing and guiding a sheet 101 therethrough. The resonator chamber 103 has on the downstream side a terminal end slider 115 made of metal. The terminal end slider 115 is horizontally movable relative to the resonator chamber 103, and extends into the resonator chamber 103.

FIG. 16B is a schematic perspective view of the resonator chamber 103 portion. A microwave generated from the magnetron 110 is led into the resonator chamber 103. For understanding, FIG. 16B shows the microwave in a substantially sine wave form.

The resonator chamber 103 has the side surface 109 and a side surface 109' which are opposite to each other and are provided with the passing portion 107 and a passing portion 107', respectively. The sheet 101 passes through the passing portion 107', and is led into the resonator chamber 103. Then, the sheet 101 passes through the passing portion 107 opposite to the passing portion 107', and is ejected therefrom. The moving direction of the sheet 101 is indicated by an arrow.

The passing portions 107 and 107' include therein a movable element 104. The element 104 is a bar made of polytetrafluoroethylene (PTFE), and extends into the resonator chamber 103.

In JP-A-2003-295692, the position of the element 104 can be longitudinally moved in the resonator chamber 103. The position of the element 104 is moved to regulate the resonance conditions in the resonator chamber 103. Therefore, the microwave absorption onto the sheet 101 can be enhanced.

In addition, JP-A-2010-089351 discloses a technique using the microwave to dry ink discharged onto a media, in an inkjet printer.

The inkjet printer disclosed in JP-A-2010-089351 uses a waveguide having a two-stage horseshoe shape which is bent in a center section and includes a reflection terminal member slidable within a range of ½ of a wavelength λ of a supplied microwave in a terminal section.

A standing microwave formed in the waveguide is normally formed in a cycle of λ/2, so that uneven heating occurs according to a position. However, according to the configuration disclosed in JP-A-2010-089351, a peak position of energy of the standing microwave can be moved within a range of λ/2 by moving the reflection terminal member. Thus, energy of the microwave at any position in the waveguide can be averaged, so that the ink can be prevented from being unevenly dried.

In the technique of JP-A-2003-295692, the coupling aperture 114 with a diaphragm is provided between the input coupling converter 113 and the resonator chamber 103. Thereby, a standing microwave is formed in the resonator chamber 103. However, the diaphragm portion has an inclined side surface which causes microwave reflection, thereby lowering transmission efficiency. That is, to lead a high-energy microwave into the resonator chamber 103, it is necessary to generate higher microwave energy from the magnetron. As a result, the energy consumption is increased.

In the microwave field, it has been known that the temperature of a microwave-exposed sheet is increased. However, in an application in which it is necessary to fuse toner onto a sheet in a very short time in, e.g., a printer and a copy machine, a method which enables temperature increase only for fusing toner in such a short time cannot be established at present. As a typical example of electronic equipment which performs heating with a microwave, e.g., a microwave oven has been known. However, even when a sheet put into an electronic oven is applied with a microwave for one to about several seconds, the temperature of the sheet cannot be increased by 100° C. or more.

In the technique of JP-A-2003-295692, it is difficult to fuse toner in a very short time. In addition, to shorten the fusing time by using the technique, it is necessary to generate very high microwave energy from the magnetron.

In addition, in order to use the technique of JP-A-2010-089351, the specific waveguide bent into the horseshoe shape is needed. In order to form this bent section, it is necessary to prevent an output of the discharged microwave from being suppressed, so that an elaborate producing process is required. Therefore, it is considered that this is not suitable for mass production, and manufacturers' cost is increased.

SUMMARY OF THE INVENTION

When the heating process is performed with the standing microwave, the uneven heating occurs at a position of a peak and a position of a bottom of the energy of the standing microwave as described above. An object of the present invention is to provide a microwave heating device capable of preventing the uneven heating from occurring and enhancing heating efficiency with as a simple configuration as possible. In addition, an object of the present invention is to provide a non-contact type image fixing apparatus with high heating efficiency by using such a microwave heating device for fusing developing particles.

In order to attain the above object, a microwave heating device according to the present invention includes a microwave generating portion outputting a microwave, and a conductive heating chamber guiding the microwave, and having a short-circuited terminal section of the microwave in a traveling direction, in which the heating chamber is divided into a plurality of spaces until a position of the terminal section along the traveling direction by a barrier section including a conductive material, and has an opening provided so that an object to be heated passes through the heating chamber in a direction non-parallel to the traveling direction of the microwave, phase shifters having different lengths with respect to the traveling direction and including a dielectric body having permittivity higher than air are inserted in the positions of the terminal sections toward the microwave generating portion, in the spaces except for at least one of the plurality of spaces, to mutually differentiate positions of bottoms of standing microwaves formed in the respective spaces with respect to the traveling direction, impedance adjusters having different lengths with respect to the traveling direction and including a dielectric body having permittivity higher than air are inserted in positions on an upstream side of a region passed by the object to be heated, in the spaces except for at least one of the plurality of spaces, to reduce differences in impedance in the spaces from an entrance of the heating chamber for receiving the microwave to the terminal section, including the phase shifters, and a square tubular waveguide including a conductive material makes a connection between a microwave output end of the microwave generating portion and the terminal section of the heating chamber, except for apart of the opening provided for passing the object to be heated.

According to the above configuration, the phases of the standing microwaves formed in the respective spaces can be shifted in the traveling direction of the microwave, so that the positions of the bottoms and the positions of the peaks of the respective standing microwaves can be mutually shifted. Thus, even in the case where the object to be heated is not sufficiently heated because when it passes through the one space, it passes through the position of the bottom of the standing microwave in that space, the bottom of the standing microwave is not formed in that position when it passes through the other space. That is, after the object to be heated passing through the all spaces, every position of the object to be heated has passed through the position of the standing microwave having the high energy amount.

In addition, according to this configuration, the impedance adjuster is inserted so as to reduce the differences of the impedance in the spaces generated because the phase shifters are inserted. Therefore, there is no large difference in energy amount of the microwave which enters each space.

As a result, as for the standing microwaves formed in the respective spaces, only their phases can be shifted while they have almost the same energy amount (electric field intensity). Thus, the heating efficiency can be improved. In addition, the heating chamber is divided into the plurality of spaces and the phase shifter and the impedance adjuster are just inserted in each space, so that the heating efficiency is improved with the very simple configuration.

In addition, an outer shape of the phase shifter may be determined such that positions of the bottoms of the standing microwaves formed in the respective spaces are mutually shifted by $\lambda g/(2N)$ with respect to the traveling direction, in which N (N is 2 or more natural number) represents the number of the spaces, and $\lambda g$ represents an internal wavelength of the standing microwave formed in the waveguide of the heating chamber.

In this configuration, the positions of the bottoms of the standing microwaves in the respective spaces can be most uniformly shifted, so that the uneven heating can be eliminated.

Furthermore, a length of the phase shifter inserted into the space with respect to the traveling direction may be defined by an integral multiple of $\lambda g'/2$, in which $\lambda g'$ represents an internal wavelength of a standing microwave formed in the dielectric body of the phase shifter.

In this configuration, the bottom of the standing microwave is formed in an end face position of the phase shifter on a side of the microwave generating portion in each space. In addition, as for the space in which the phase shifter is not inserted, the bottom of the standing microwave is formed in the terminal section. According to this method, the position of the bottom of the standing microwave can be intentionally shifted with respect to each space.

In addition, the phase shifter and the impedance adjuster may include the same material, and a total value of lengths of the phase shifter and the impedance adjuster provided in the space from the entrance of the heating chamber to the terminal section with respect to the traveling direction is equal to each other.

In this way, the impedance in each space can be easily equalized.

In addition, the phase shifter and the impedance adjuster may include ultra high molecular weight polyethylene.

In this configuration, the processability is improved, and the manufactures' cost can be reduced because it is available at a relatively low price.

In addition to the above configuration, it is preferable to provide an electric field transformer including a dielectric body having permittivity higher than air in the space, in which the electric field transformer has a length larger than $(4N-3)\lambda gz/8$ but smaller than $(4N-1)\lambda gz/8$ with respect to the traveling direction, in which $\lambda gz$ represents an internal wavelength of a standing microwave formed in a dielectric body of the electric field transformer, and N (N>0) represents a natural number, and is provided on a side closer to the microwave generating portion than the insertion position of the impedance adjuster with respect to the traveling direction so as to include the bottom of the standing microwave.

In one configuration, the electric field transformer is set in such a manner that its width is an odd multiple of $\frac{1}{4}\lambda gz$ and its face of a side of the terminal section of the heating chamber is positioned in the bottom of the standing microwave.

In this configuration, the electric field intensity can be increased on the downstream side of the electric field transformer, that is, in the region passed by the object to be heated, compared with the upstream side. Thus, the temperature in the heating chamber can be rapidly raised in a short time.

In addition, the electric field transformer may include the same material as that of the phase shifter and the impedance adjuster, and it may include ultra high molecular weight polyethylene.

When the same material is used, the production can be performed in a simple manner, and the manufacturer's cost can be expected to be reduced.

In addition, an image fusing device according to the present invention includes the microwave heating device having the above characteristics, in which when a recording sheet attached with a developer passes through the opening and is heated in the heating chamber, the developer is fused on the recording sheet.

In this configuration, the developer can be fused on the recording sheet in a short time, so that the image fusing apparatus without a mechanical fusing mechanism can be realized.

According to the present invention, as for the standing microwaves formed in the respective spaces, only their phases can be shifted while the standing microwaves have almost the same energy amount (electric field intensity), so that the heating efficiency can be considerably improved with the simple configuration.

BRIEF DESCRIPTION OF THE DRAWINGS

FIG. 155 is a graph showing change in electric field intensity when the electric field transformer having a width of 0.37 λg' is interposed.

DETAILED DESCRIPTION OF EMBODIMENTS OF THE INVENTION

[First Embodiment]

Figure 1:
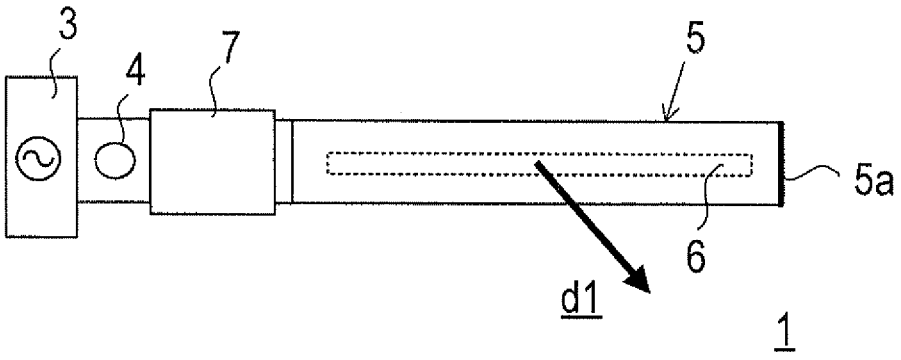
FIG. 1 is a conceptual configuration diagram of a microwave heating device according to a first embodiment of the present invention.

FIG. 1 is a conceptual configuration diagram of a microwave heating device according to the present invention, and shows a state seen from one side. A microwave heating device 1 shown in FIG. 1 includes a microwave generating portion 3 which is a magnetron, a heating chamber 5 for heating an object to be heated with a microwave, and a tuner 7 between the microwave generating portion 3 and the heating chamber 5. In addition, in this embodiment, an isolator 4 is provided between the microwave generating portion 3 and the tuner 7. The isolator 4 is a protective device which converts the electric power of the microwave reflected from the tuner 7 in the direction of the microwave generating portion 3 side into heat energy and stably operates the microwave generating portion 3. However, in the device of the present invention, the isolator 4 is not always necessary.

In addition, as shown in FIG. 1, the most downstream side of the heating chamber 5 is terminated with a conductor (5*a*).

Note that this terminal 5*a* may include the same metal material as that of the heating chamber 5.

The microwave generating portion 3 and the tuner 7, and the tuner 7 and the heating chamber 5 are connected by square tubular frames made of conductive materials (such as metals), thereby confining the generated microwave. However, the heating chamber 5 has a slit 6 (corresponding to an "opening").

Figure 16A:
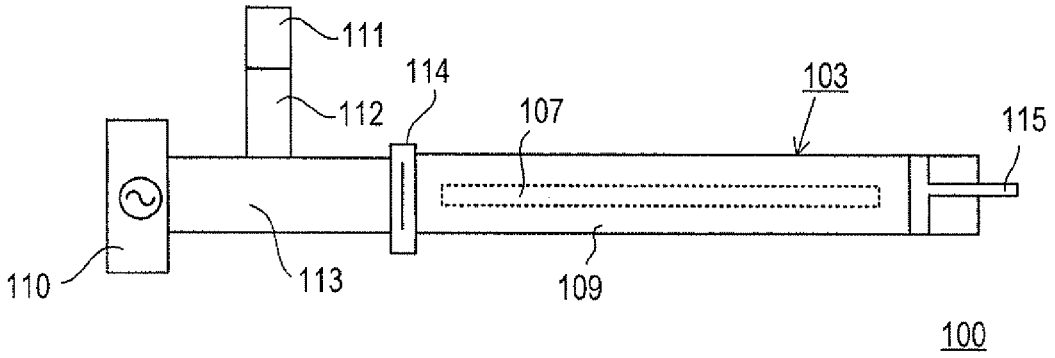
FIG. 16A is a conceptual diagram showing a configuration of a conventional microwave device.
Figure 16B:
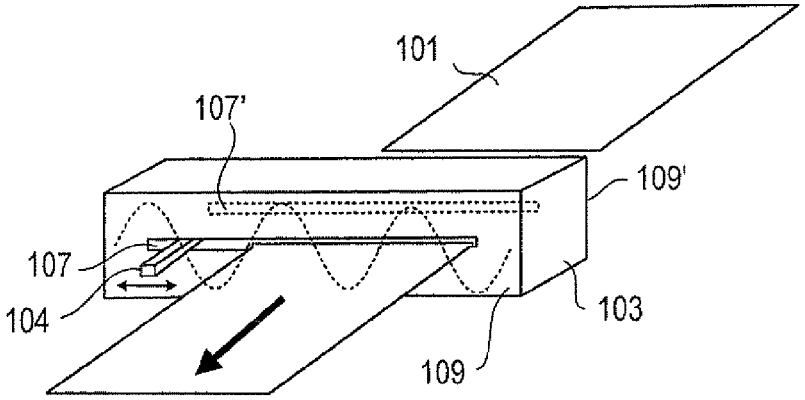
FIG. 16B is a schematic perspective view of a resonator chamber portion of the conventional microwave device.

As in the conventional configuration shown in FIGS. 16A and 16B, in this embodiment, the heating chamber 5 is provided with the slit 6 for passing a sheet (corresponding to a "member to be heated") therethrough. In FIG. 1, the sheet passes from the rear to the front in the direction of arrow d1. That is, the heating chamber 5 also has, in the rear side surface, a slit opposing the slit 6. The sheet enters into the heating chamber 5 through the slit in the rear side surface, is heated in the heating chamber 5, and is ejected from the slit 6 in the front side surface to the outside of the heating chamber 5. Toner particles adhere onto the surface of the sheet. The adherent toner particles are heated in the heating chamber 5, and are fused onto the sheet.

Figure 2:
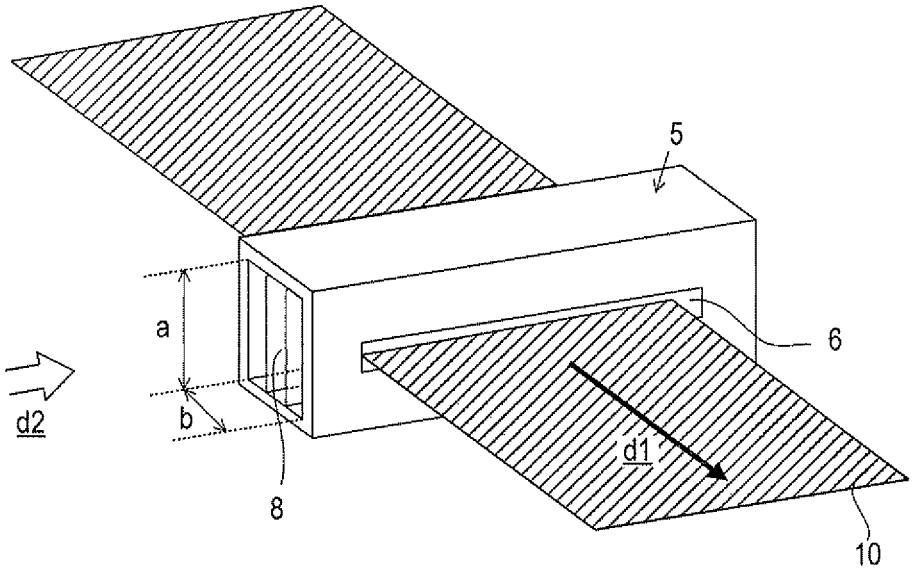
FIG. 2 is a perspective view showing a configuration of a heating chamber.

FIG. 2 is a perspective view showing a configuration of the heating chamber 5. The heating chamber 5 has a square tubular shape surrounded by a conductor such as a metal while the heating chamber 5 is provided with the slit 6 and a microwave inlet 8 on its predetermined surfaces. That is, the heating chamber 5 is short-circuited with the conductor on a face positioned most downstream side with respect to the microwave generating portion 3 and opposed to the microwave inlet 8. A constituent material of the heating chamber 5 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a conductive material) metal, alloy such as brass, and resin.

The heating chamber 5 has the microwave inlet 8 in the side surface on the microwave generating portion 3 side. The microwave inlet 8 is an opening for leading a microwave into the heating chamber 5. The microwave outputted from the microwave generating portion 3 is led from the microwave inlet 8 into the heating chamber 5 in the direction indicated by arrow d2. The microwave inlet 8 has a substantially rectangular shape such that a is a dimension perpendicular to advancing direction d1 of a sheet 10 and b is a dimension parallel to d1.

In this embodiment, the microwave propagating in the heating chamber 5 is in the basic mode (H10 mode or TE10 mode).

Thus, according to a configuration in the present embodiment, the heating chambers 5 is divided into three-row spaces along the traveling direction d2 of the microwave, as will be described in detail below with reference to FIG. 3. Three-row spaces are provided in the present embodiment, but the number is not limited to three in realizing the present invention.

The slit 6 preferably has a minimum size necessary for passing the sheet 10 to be heated therethrough. This is because when the slit 6 is excessively large, the introduced microwave leaks through the slit 6, and the power of the microwave in the heating chamber 5 may be reduced.

Figure 3:
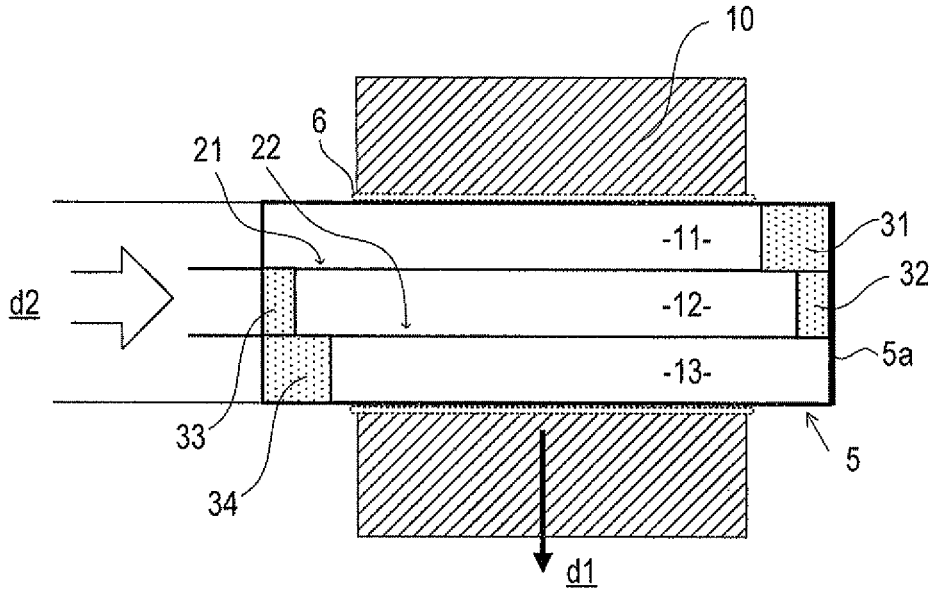
FIG. 3 is a schematic plan view showing a detailed configuration of the heating chamber.

FIG. 3 is a schematic plan view showing a detailed configuration of the heating chamber 5 in the present embodiment. In addition, the heating chamber 5 has the square tubular shape surrounded by the conductor such as the metal, but here, a part of the inside of the heating chamber 5 is transparently illustrated for convenience of the description.

As described above, the slit 6 is provided in the side face of the heating chamber 5, and the sheet 10 can pass the inside of the heating chamber 5 through the slit 6 in the direction d1. Thus, the microwave generated from the microwave generating portion 3 can enter the heating chamber 5 in the direction d2 from a left side in the drawing.

The heating chamber 5 has partition plates 21 and 22 including the conductive material (metal in the present example) in the same direction as the traveling direction of the microwave, and it is divided into the three spaces such as spaces 11, 12, and 13. Here, it is to be noted that each of the partition plates 21 and 22 has a gap (or slit) so that the sheet 10 can pass through in the direction d1. Thus, it is preferable that the partition plates be brought close to an inner wall of the heating chamber 5 as much as possible so that a passage communicating between the adjacent spaces does not exist except for the gap.

Furthermore, according to the present embodiment, phase shifters are inserted so as to mutually shift phases of standing microwaves traveling the respective spaces. More specifically, a phase shifter 31 is inserted in the space 11, a phase shifter 32 is inserted in the space 12, and a phase shifter not inserted in the space 13. Here, the phase shifter 31 is twice as long as the phase shifter 32 with respect to the direction d2.

Each of the phase shifters 31 and 32 includes a material having high permittivity and inserted so as to block each space over its length. Here, ultra-high-molecular-weight (UHMW) polyethylene is used as the material, but a resin material such as polytetrafluoroethylene, quartz, and high-permittivity material can be used. In addition, they preferably include a material which is resistant to heat as much as possible. From the viewpoint of the processability and the cost, UHMV polyethylene is preferably used.

Furthermore, impedance adjusters 33 and 34 are inserted in terminal sections in the spaces 12 and 13, respectively.

Here, the impedance adjusters 33 and 34 include the same material as that of the phase shifters 31 and 32.

In the case where the same material as that of the phase shifters 31 and 32 is used for the impedance adjusters 33 and 34, the impedance adjuster 33 to be inserted in the space 12 has the same length as that of the phase shifter 32 to be inserted in the same space 12 with respect to the direction d2. In addition, the impedance adjuster 34 to be inserted in the space 13 has the same length as that of the phase shifter 31 to be inserted in the space 11 with respect to the direction d2. Thus, the impedances of the spaces 11, 12, and 13 can be easily equalized when viewed from an entrance of the heating chamber 5 to the terminal section.

In addition, hereinafter, the length in the direction d2 is occasionally referred to as a "width" simply.

Figure 4:
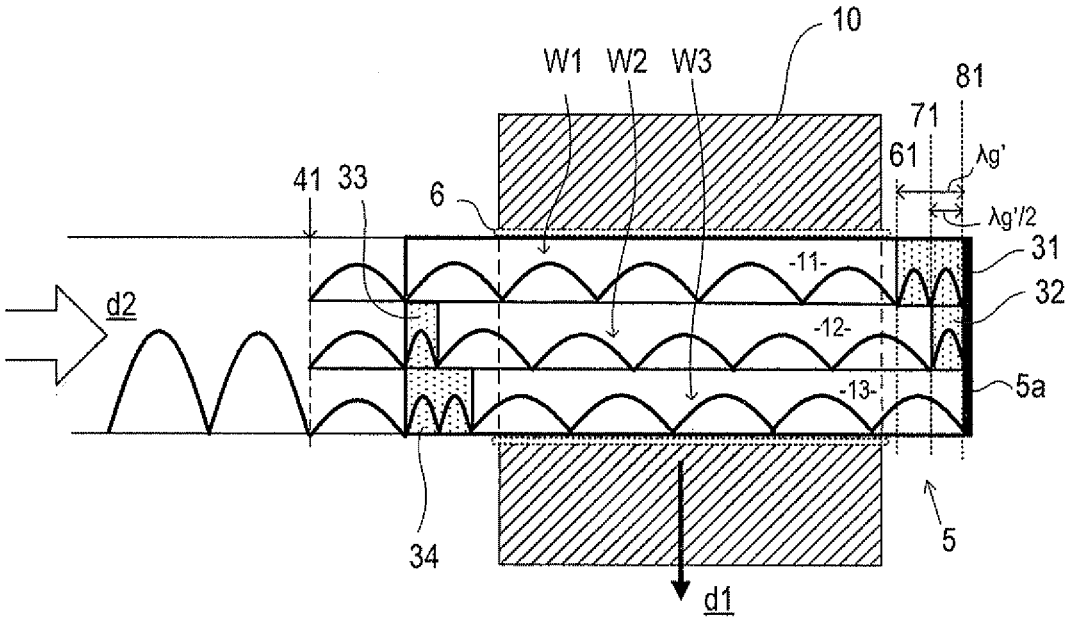
FIG. 4 is a conceptual diagram of a standing microwave formed in the heating chamber.

FIG. 4 conceptually shows a state of the standing microwaves formed in the spaces 11, 12, and 13 when the microwave is introduced in the configuration in FIG. 3. Here, it is assumed that a width of the phase shifter 31 is $\lambda g'$ and a width of the phase shifter 32 is $\lambda g'/2$. Here, $\lambda g'$ represents a wavelength of the standing microwave formed in the same dielectric body as the phase shifters 31 and 32 (hereinafter, referred to as a "wavelength in the dielectric body").

In addition, hereinafter, for the d2 direction, the terminal end 5*a* side is called "downstream", and the microwave generating portion 3 side is called "upstream".

As shown in FIG. 4, the phase shifters 31 and 32 are inserted in the spaces 11 and 12, respectively so that their end faces (first faces) on the downstream side are positioned in the terminal section 5*a*. When the phase shifters are inserted under this condition, a bottom of a standing microwave W1 appears at a position 61 of an upstream end face (second face) of the phase shifter 31, in the space 11. Similarly, a bottom of a standing microwave W2 appears at a position 71 of an end face (second face) of the phase shifter 32 on the upstream side, in the space 12. In addition, a bottom of a standing microwave W3 appears at a position 81 of the terminal section 5*a*, in the space 13 where the phase shifter is not inserted. In addition, in FIG. 4, a head section in which the supplied microwave is distributed into the spaces 11, 12, and 13 is shown as a "branching section 41".

Thus, the phases of the standing microwaves W1, W2, and W3 existing in the spaces 11, 12, and 13, respectively can be mutually shifted, so that positions of peaks of the standing microwaves W1, W2, and W3 can be mutually shifted in the direction d2. Thus, when the sheet 10 passes through the heating chamber 5 in the direction d1, it passes through a high-energy region while passing through the spaces 11, 12, and 13. Thus, the sheet 10 is prevented from being unevenly heated.

Figure 5:
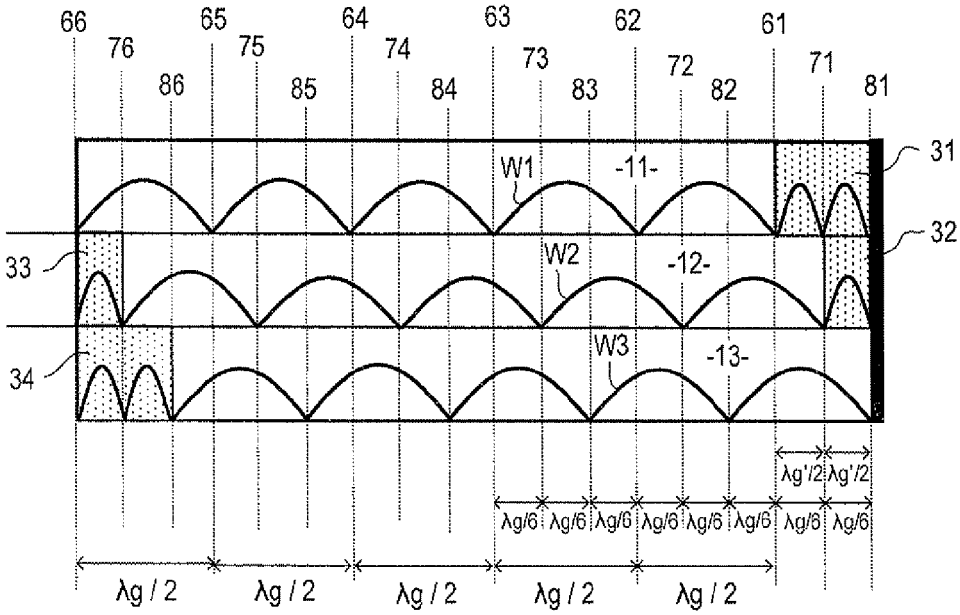
FIG. 5 is a conceptual diagram for describing a phase shift of the standing microwave formed in the space in the heating chamber.

In addition, as for a method for shifting the phases of the standing microwaves W1, W2, and W3 formed in the spaces 11, 12, and 13, respectively, when the phases are shifted by ⅙ of an internal wavelength $\lambda g$ of the standing microwave formed in the heating chamber 5, energy efficiency can be most highly enhanced (refer to FIG. 5). That is, the material and the width of the phase shifters 31 and 32 are to be determined so as to realize a following equation 1.

$$\frac{\lambda g'}{2} = \frac{\lambda g}{6} \qquad \text{[Equation 1]}$$

In addition, in the equation 1, a numerical value of $\lambda g/6$ is provided because the heating chamber is divided into the three spaces, so that when it is divided into N in general, the phase should be shifted by $\lambda g/(2N)$ to most highly enhance the energy efficiency.

At this time, bottoms (61,62,63,64,65,66) of the standing microwave W1 formed in the space 11, bottoms (71,72,73,74,75,76) of the standing microwave W2 formed in the space 12, and bottoms (81,82,83,84,85,86) of the standing microwave W3 formed in the space 13 can be equally shifted in position, respectively. Thus, even when the sheet 10 is not sufficiently heated at the time of passing through the position of the bottom 62 in the space 11, it can be sufficiently heated at the time of continuously passing through the spaces 12 and 13 because the positions in these spaces do not correspond to the bottoms of the standing microwaves. As shown in FIG. 5, by equally shifting the phases of the standing microwaves W1, W2, and W3, when the sheet 10 passes through in the direction d1, the uneven heating can be prevented with respect to the position in the direction d2. That is, by shifting the phases based on the condition in the equation 1, the most highly energy state can be realized in the heating chamber 5.

However, it is to be noted that the condition of the equation 1 need not be strictly established in realizing the effect of the present invention. When the phase of the standing microwave is shifted in at least each of the spaces 11, 12, and 13, the effect of preventing the uneven heating can be provided, compared with the case where the phase is not shifted. This will be described below based on an experiment result.

Next, the impedance adjusters 33 and 34 will be described. As described in the above, the phase shifters 31 and 32 are inserted in order to mutually shift the phases of the standing microwaves W1, W2, and W3 in the spaces 11, 12, and 13, respectively. Meanwhile, the impedance adjusters 33 and 34 are inserted in order to equalize (substantially equalize) the impedance in each space so that the microwave generated from the microwave generating portion can be equally (substantially equally) dispersed and inputted to the spaces 11, 12, and 13.

In order to disperse and input the microwave maintaining almost an equivalent energy amount into the spaces 11, 12, and 13, it is necessary to substantially equalize the impedance in each space. This will be described in detail with reference to the experiment result.

COMPARISON EXAMPLE 1

Figure 6A:
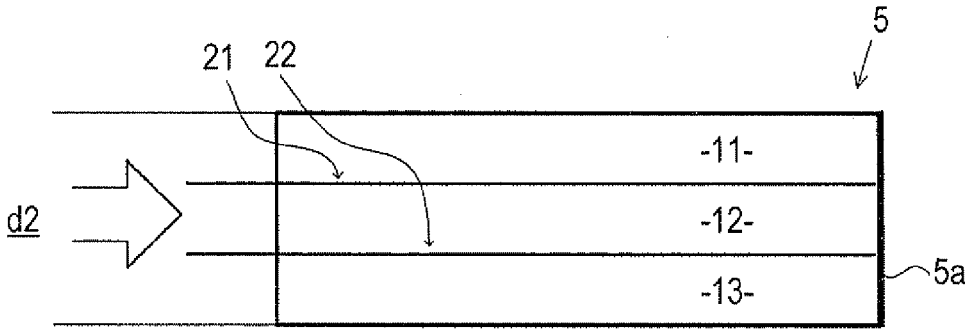
FIG. 6A is a conceptual diagram in a comparison example 1.
Figure 6B:
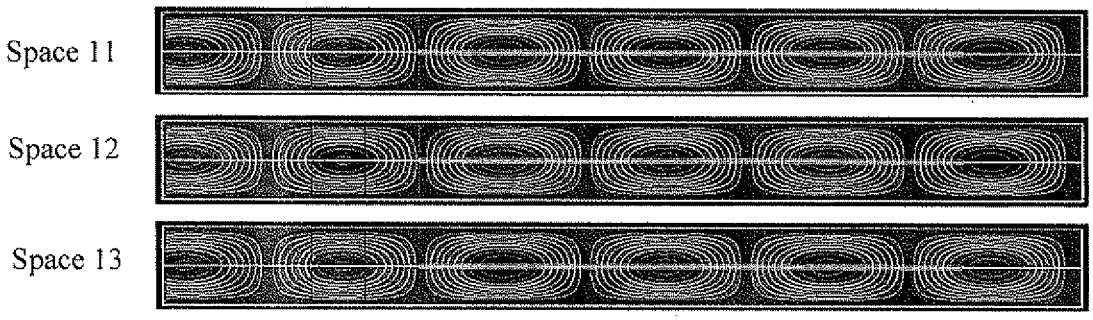
FIG. 6B is a view showing an electric field distributed state of a standing microwave in the comparison example 1 with contour lines.
Figure 6C:
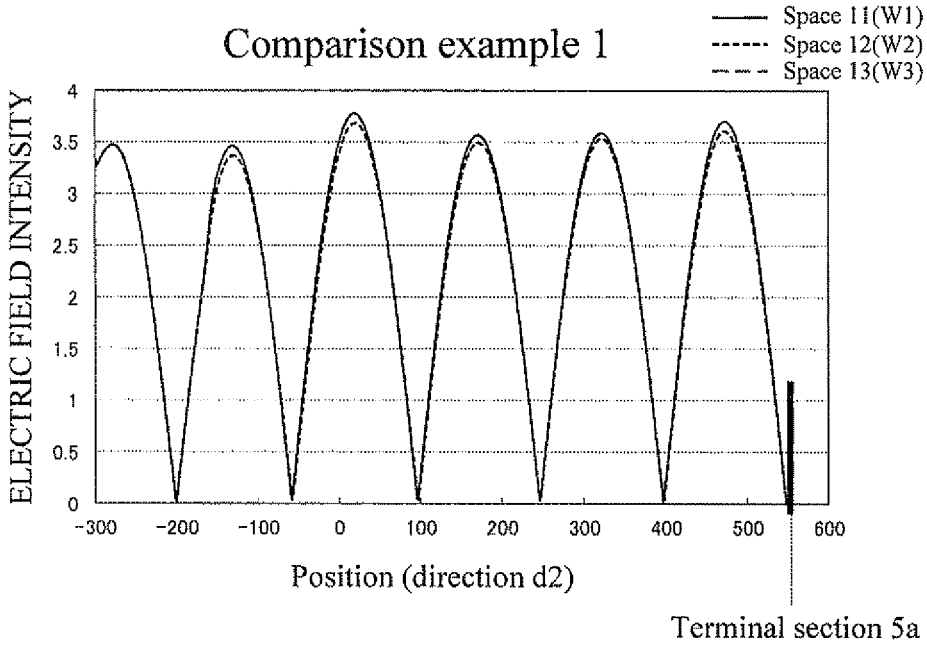
FIG. 6C is a view showing a relationship between a position and electric field intensity in the electric field distributed state of the standing microwave in the comparison example 1 with a graph.

FIG. 6A shows a conceptual configuration diagram when the heating chamber 5 is simply divided into the three spaces 11, 12, and 13 with the partition plates 21 and 22. FIGS. 6B and 6C show an electric field distribution of the standing microwave existing in each space when the microwave is introduced in the above state in the direction d2. FIG. 6B is a view showing an electric field distribution state of the standing microwave in a comparison example 1 with contour lines. FIG. 6C is a view showing a relationship between a position and electric field intensity in the comparison example 1 with a graph.

In addition, in the comparison example 1, microwave generation conditions from the microwave generating portion 3 are set such that output energy is 400 W, and an output frequency is 2.45 GHz. In addition, the heating chamber 5 and a waveguide are made of aluminum. This is similar in comparison examples 2 and 3, and examples 1 and 2 which will be described below.

Furthermore, in the following Comparison examples and the Examples, following devices are used in common.

The microwave generating portion 3: A product manufactured by MICRO DEVICE CO. LTD (at present, MICRO ELECTRO CO. LTD) is used. As the generating conditions, an output energy is 400 W, and an output frequency is 2.45 GHz.

The isolator 4: A product manufactured by MICRO DEVICE CO. LTD (at present, MICRO ELECTRO CO. LTD) is used.

The heating chamber 5: An aluminum waveguide provided with the slit 6

The sheet 10: A commercially available PPC (Plain Paper Copier) sheet called neutralized paper is used.

Referring to FIG. 6B, it is understood that almost equivalent contour lines are formed in each of the spaces 11, 12, and 13, and the microwave is dispersed and inputted with almost the same power. That is, it is found that by providing the metal partition plates 21 and 22 in the heating chamber 5, the introduced microwave can be dispersed into the respective spaces.

Meanwhile, referring to FIG. 6C, it is found that the electric field intensity each of the standing microwaves W1, W2, and W3 formed in the spaces is the same at the position in the direction d2. That is, the positions of the bottoms of the standing microwaves W1, W2, and W3 are all almost the same, and the positions of the peaks thereof are also almost the same. Therefore, when the heating chamber 5 is heated in this configuration situation, the electric field intensity is different between the position of the bottom and the position of the peak, so that the uneven heating occurs. In addition, in this experiment, the electric field intensity of the standing microwave W3 shows almost the same value as that of the standing microwave W1 by the position, so that the standing microwave W3 overlaps with the standing microwave W1 on the graph.

COMPARISON EXAMPLE 2

As described above, in order to eliminate the uneven heating as much as possible, it is important to mutually shift the positions of the bottoms of the standing microwaves formed in the respective spaces. Therefore, according to a comparison example 2, it is tried to shift the phases of the standing microwaves formed in the respective spaces by simply shifting the positions of the terminal sections of the respective spaces.

Figure 7A:
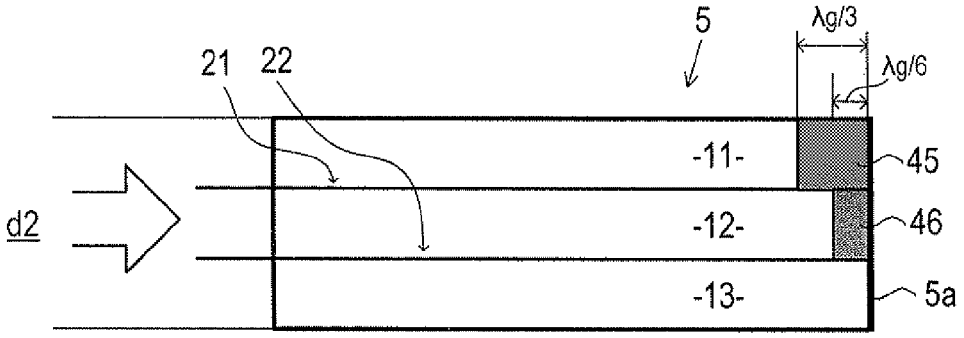
FIG. 7A is a conceptual diagram in a comparison example 2.

FIG. 7A is a conceptual configuration diagram in the comparison example 2. Specifically, a metal plate 45 having a width of λg/3 is inserted forward from the terminal section 5*a* in the space 11, and a metal plate 46 having a width of λg/6 is inserted forward from the terminal section 5*a* in the space 12. The space 13 does not have a metal plate, and it is configured such that the microwave terminates in the terminal section 5*a*.

When a conductive short-circuit plate is provided as the terminal section, as for the microwave introduced in the direction d2, the bottom of the standing microwave is formed at the position of the terminal section. Thus, when the metal plate 45 having the width of λg/3 is inserted forward from the terminal section 5*a* in the space 11, the standing microwave formed in the space 11 can be designed so that the bottom is formed at a position λg/3 ahead from the terminal section 5*a*. Similarly, when the metal plate 46 having the width of λg/6 is inserted forward from the terminal section 5*a* in the space 12, the standing microwave formed in the space 12 can be designed so that the bottom is formed at a position λg/6 ahead from the terminal section 5*a*. Thus, in this configuration, when the phases of the standing microwaves formed in the spaces can be mutually shifted, the uneven heating can be eliminated.

Figure 7B:
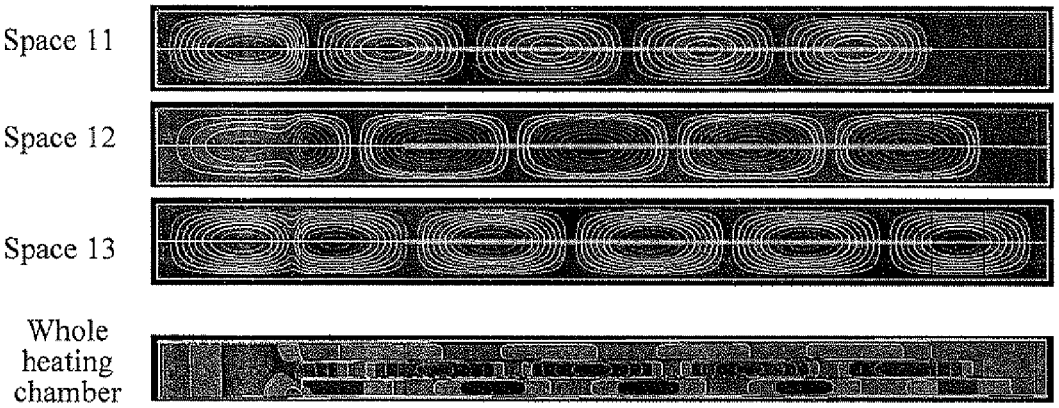
FIG. 7B is a view showing an electric field distributed state of a standing microwave in the comparison example 2 with contour lines.
Figure 7C:
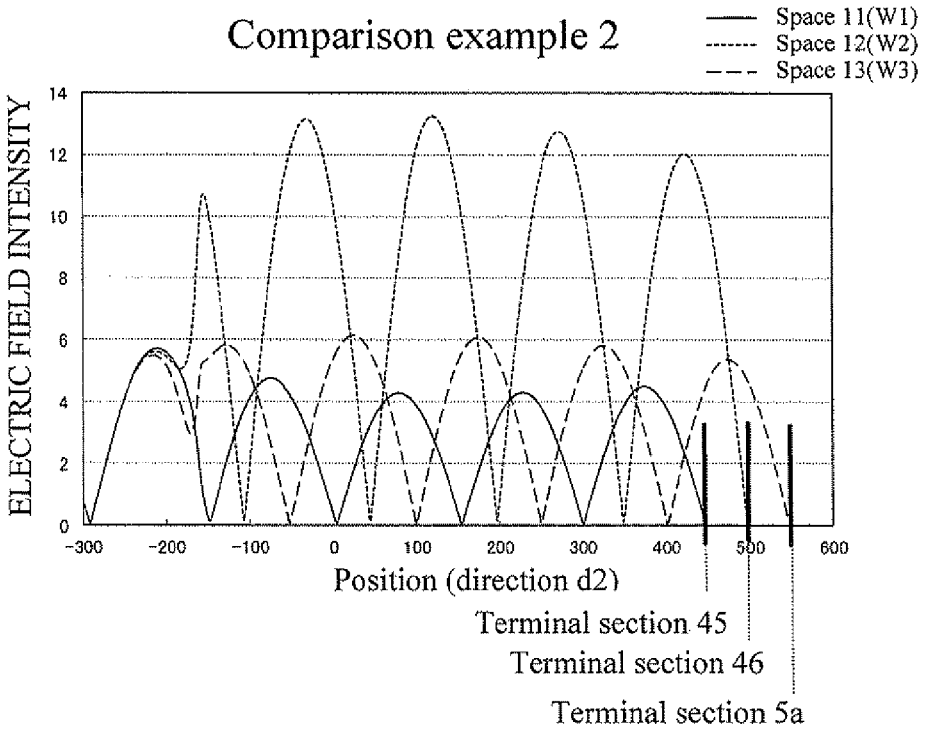
FIG. 7C is a view showing a relationship between a position and electric field intensity in the electric field distributed state of the standing microwave in the comparison example 2 with a graph.

FIGS. 7B and 7C show an electric field distribution of the standing microwave in each space when the microwave is introduced in the direction d2 in the configuration of FIG. 7A. FIG. 7B is a view showing an electric field distribution state of the standing microwave in the comparison example 2 with contour lines. FIG. 7C is a view showing a relationship between a position and electric field intensity in the comparison example 2 with a graph.

In addition, the contour drawing shown in FIG. 7B is a color drawing in fact, and configured with colors like the spectrum distribution. That is, when the electric field intensity is low, it is shown with a violet or blue color, and when the electric field intensity is high, it is shown with a red or orange color. In the monochrome drawing shown in this specification, the red line provided when the electric field intensity is high is displayed with a "blackish" color, and the line other than that color is displayed with a "whitish" color. That is, the parts in which many blackish lines are shown in a region surrounded by the white lines mean that the electric field intensity is very high.

Referring to FIGS. 7B and 7C, it is found that the electric field intensity is high in the space 12, while the electric field intensity is low in the spaces 11 and 13. Referring to FIG. 7C, the standing microwaves W1, W2, and W3 formed in the spaces are mutually shifted in phase for sure, and the positions of the bottoms of the respective standing microwaves can be shifted. However, since the electric field intensity differs among the standing microwaves, the uneven heating occurs based on the position after heated in this configuration. For example, there is a considerable difference in heating degree between a vicinity of the position of the peak of the standing microwave W2 in the space 12, and a vicinity of the position of the peak of the standing microwave W1 in the space 11, with respect to the direction d2.

That is, as shown in the comparison example 2, it is found that when the terminal positions are simply changed in the direction d2 in order to shift the phases of the standing microwaves formed in the respective spaces, an energy amount differs among the standing microwaves formed in the respective spaces. Thus, the effect of eliminating the uneven heating is hardly expected in the configuration of the comparison example 2.

EXAMPLE 1

As described above, in order to eliminate the uneven heating as much as possible, it is important to mutually shift the positions of the bottoms of the standing microwaves formed in the respective spaces. However, like the comparison example 2, it is found that when the positions of the terminal sections of the spaces are shifted in the direction d2 in order to shift the positions of the bottoms, the electric field intensity differs among the standing microwaves formed in the respective spaces.

Like the comparison example 2, the phenomenon that the electric field intensity differs among the standing microwaves formed in the respective spaces is caused by the fact that the impedances are different among the spaces when viewed from the heating chamber entrance to the terminal section 5*a*. That is, as a result of the insertion of the metal plates 45 and 46 in the terminal section, the impedance differs among the spaces 11, 12, and 13, and as a result, the electric field intensity differs among the standing microwaves in the respective spaces.

Accordingly, the present invention employs the configuration described with reference to FIGS. 3 to 5 to realize the situation in which the phases of the standing microwaves formed in the spaces are mutually differentiated while the impedance in the spaces is almost the same. This configuration will be described as an "example 1" with reference to an experiment result.

Figure 8A:
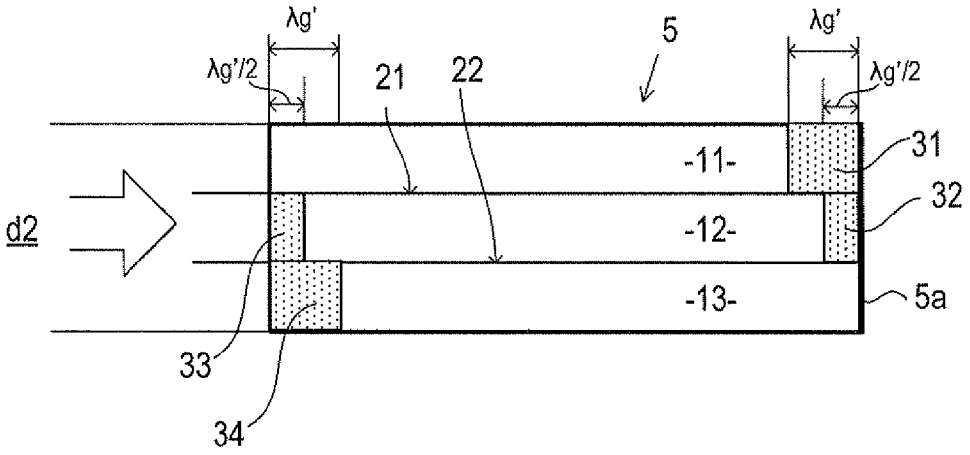
FIG. 8A is a conceptual diagram in an example 1.

FIG. 8A shows a conceptual configuration diagram of the example 1. As already described above with reference to FIGS. 3 to 5, according to the example 1, the phase shifter 31 having the width of λg' is inserted from the terminal section 5*a* toward the upstream side, in the space 11. In addition, the phase shifter 32 having the width of λg'/2 is inserted from the terminal section 5*a* toward the upstream side, in the space 12. Each of the phase shifters 31 and 32 includes ultra high molecular weight polyethylene serving as one of a material having high electric conductivity.

In addition, according to the example 1, the impedance adjuster 33 having the width of λg'/2 is inserted from the vicinity of the entrance toward the downstream side, in the space 12, and the impedance adjuster 34 having the width of λg' is inserted from the vicinity of the entrance toward the downstream side, in the space 13. The impedance adjusters 33 and 34 include the same material as that of the phase shifters 31 and 32. That is, the phase shifter 32 and the impedance adjuster 33 include completely the same member in the present example, and the phase shifter 31 and the impedance adjuster 34 include completely the same member in the present example.

Figure 8B:
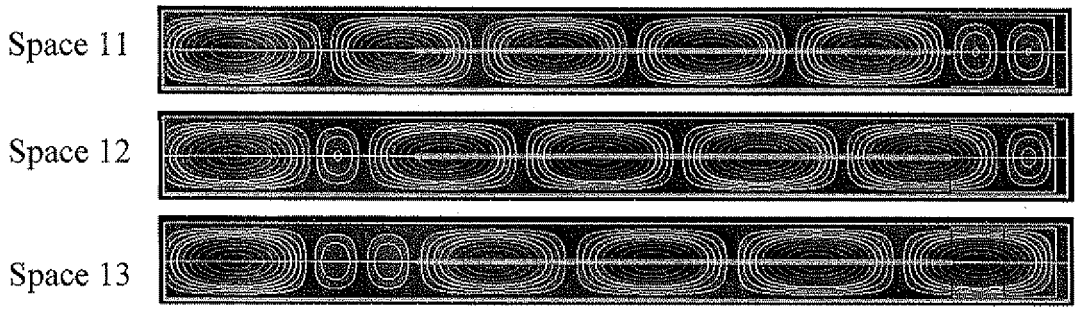
FIG. 8B is a view showing an electric field distributed state of a standing microwave in the example 1 with contour lines.
Figure 8C:
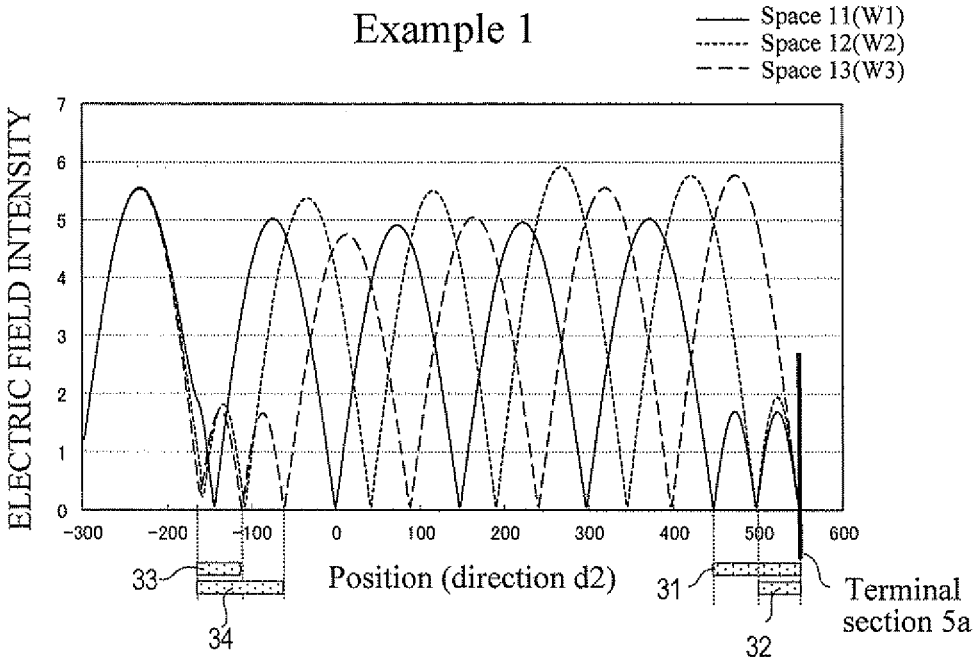
FIG. 8C is a view showing a relationship between a position and electric field intensity in the electric field distributed state of the standing microwave in the example 1 with a graph.

FIGS. 8B and 8C show an electric field distribution of the standing microwaves in the respective spaces when the microwave is introduced in the direction d2 in this state. FIG. 8B is a view showing an electric field distribution state of the standing microwave in the example 1 with contour lines. FIG.

8C is a view showing a relationship between a position and electric field intensity in the example 1 with a graph.

Referring to FIGS. 8B and 8C, it is found that almost the equivalent electric field intensity is shown in each space, and the positions of the bottoms of the standing microwaves can be mutually shifted in the direction d2. Thus, when the sheet 10 is passed in the direction d1 under this configuration, it can be uniformly heated over the direction d2.

In the meantime, according to the example 1, the reason why the phase shifters 31 and 32 including the high dielectric body are introduced to mutually shift the phases of the standing microwaves is to easily adjust the impedance, in addition to mutually shift the phases. That is, as shown in the comparison example 2 (refer to FIG. 7A), when the metal plates having different widths are inserted in the terminal sections, the phases of the standing microwaves can be mutually differentiated. However, in the case of the comparison example 2, the impedance differs among the spaces, and as a result, the electric field intensity differs among the standing microwaves, which is another factor causing the uneven heating. Therefore, when the impedance in the spaces can be almost equal under the configuration in FIG. 7A, the same effect as that of the example 1 can be expected. According to a method employed in this case, the impedance of each space is calculated under the condition that the metal plate is inserted, and the impedance adjuster is inserted to substantially equalize the impedance.

However, when the phase shifter of the high dielectric body is employed instead of the metal plate, like the example 1, the impedance can be very easily adjusted. This is because, as already described, the phase shifters 31 and 32, and the impedance adjusters 33 and 34 can include the same material, respectively, and in this case, the phase shifter 31 and the impedance adjuster 34, and the phase shifter 32 and the impedance adjuster 33 can include the member having the same material and the same dimension. That is, according to the example 1, the uneven heating can be eliminated only by preparing the two ultra high molecular weight polyethylene members each having the width of λg' and having a height and a length (length in the direction d1) capable of sealing one space, and the two ultra high molecular weight polyethylene members each having a width of λg'/2 and having a height and a length (length in the direction d1) capable of sealing one space.

Thus, as described above with reference to FIG. 5, the effect of eliminating the uneven heating can be considerably enhanced by selecting the material and the dimension of the heating chamber 5, and the material of the phase shifters 31 and 32 so as to satisfy the above equation 1.

In addition, the impedance adjusters 33 and 34 are inserted in the vicinity of the entrance of the heating chamber 5 in FIG. 8A, but the impedance adjusters 33 and 34 only have to be inserted to positions on the further upstream side of the upstream side end face of the object to be heated at least when the object to be heated (such as the sheet 10) passes through.

[Second Embodiment]

Figure 9:
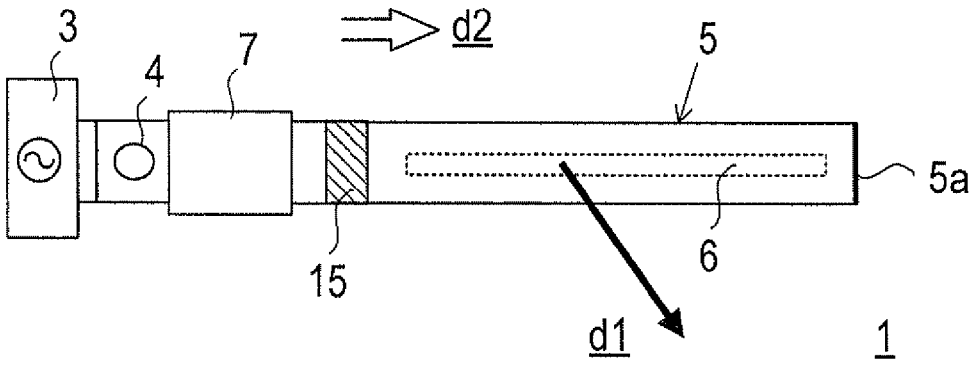
FIG. 9 is a conceptual configuration diagram of a microwave heating device according to a second embodiment of the present invention.

FIG. 9 is a conceptual configuration diagram of a microwave heating device according to a second embodiment. The microwave heating device of the second embodiment differs from the apparatus of the first embodiment in that an electric field transformer 15 is further provided on the downstream side (side of the terminal section 5*a*) of the tuner 7. More specifically, the electric field transformer 15 is provided in each of the spaces 11, 12, and 13.

The electric field transformer 15 is made of a high dielectric constant material. In this embodiment, ultra high molecular weight (UHMW) polyethylene is used. However, a resin material such as polytetrafluoroethylene, quartz, and other high dielectric constant materials can be used. In addition, the electric field transformer 15 is preferably made of a hard-to-heat material where possible. From the viewpoint of the processability and the cost, UHMV polyethylene is preferably used.

That is, when the electric field transformer 15 includes ultra high molecular weight polyethylene, the electric field transformer 15, the phase shifters 31 and 32, and the impedance adjusters 33 and 34 can be all made up of the same material.

The electric field transformer 15 has a width in the traveling direction d2 of a microwave which is an odd multiple of λgz/4 (λgz/4, 3 λgz/4, . . . ) where λgz is the wavelength of a standing microwave formed in the same dielectric as the electric field transformer 15. The electric field transformer 15 has a width which is an odd multiple of λgz/4, so that the interposition effect of the electric field transformer 15 can be the highest. However, the interposition effect of the electric field transformer 15 can be obtained by setting the width of the electric field transformer 15 to satisfy later-described relational equations.

In addition, as described above, when the electric field transformer 15 includes the same material as that of the phase shifters 31 and 32, the wavelength λgz of the standing microwave in the electric field transformer 15 coincides with the wavelength (wavelength in the dielectric body) λg' of the standing microwaves in the phase shifters 31 and 32. Hereinafter, a description will be given assuming that λgz=λg' to avoid the reference mark from being complicated.

When λ is the wavelength of a microwave generated from the microwave generating portion 3, ∈' is the dielectric constant of the electric field transformer 15, λc is a cut-off wavelength, and λg' is a dielectric wavelength, Equation 1 is established. From this relational equation, dielectric wavelength λg' can be calculated.

$$\frac{1}{\lambda^2} = \frac{\varepsilon'}{\lambda_g'^2} + \frac{1}{\lambda_c^2} \qquad \text{[Equation 2]}$$

Figure 10:
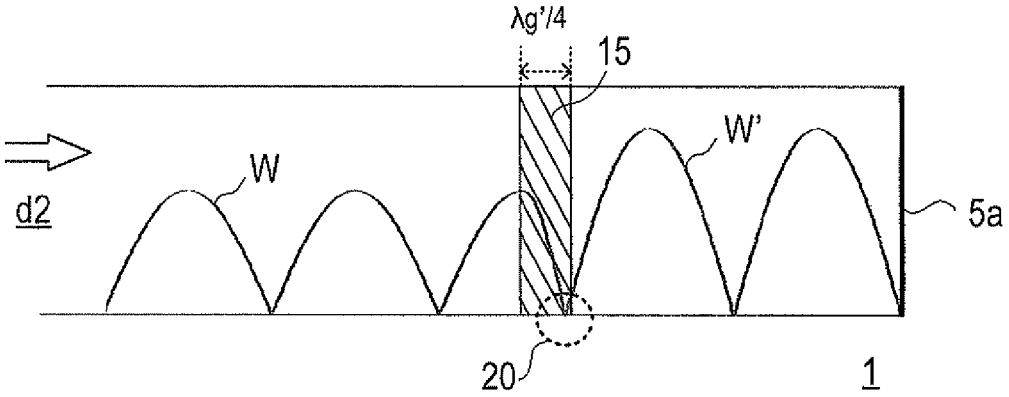
FIG. 10 is a conceptual diagram showing an electric field distribution in a waveguide when an electric field transformer is set.

As shown in FIG. 10, in this embodiment, the electric field transformer 15 is fixed. More specifically, the electric field transformer 15 is provided in a position 20 which is a bottom of a standing microwave formed in the heating chamber 5 (each of the spaces 11, 12, and 13). More specifically, the electric field transformer 15 is provided in the position 20 in which the surface of the electric field transformer 15 on the terminal end 5*a* side (downstream side) is at the bottom.

The electric field transformer 15 has a higher dielectric constant than air, so that the wavelength of the standing microwave passing in the electric field transformer 15 becomes short. Accordingly, the electric field intensity of a standing microwave W' on the downstream side (the terminal end 5*a* side) from the electric field transformer 15 can be higher. In particular, when a width L of the electric field transformer 15 is set within the range of the following relational equation, the electric field intensity of standing microwave W' can be significantly higher. In the following relational equation, N is a natural number.

(Relational Expression)

$$(4N-3)\,\lambda g'/8 < L < (4N-1)\,\lambda g'/8$$

These results will be apparent by later-described Examples.

As in the first embodiment and this embodiment, in the configuration generating the standing microwave in the heating chamber 5, a high electric field intensity portion (peak) and a low electric field intensity portion (bottom) are caused according to distance in the direction from the terminal end 5*a* toward the microwave generating portion 3. As shown in FIG. 6, in particular, by providing the electric field transformer 15 at the bottom of the standing microwave, the electric field intensity of standing microwave W' on the downstream side from the electric field transformer 15 can be higher. The toner fusibility can thus be improved.

That is, the slit 6 is provided on the downstream side from the electric field transformer 15 to pass the sheet 10 therethrough, thereby performing heating treatment based on power-increased standing microwave W'. The toner fusing time can be further shortened.

By providing the electric field transformer 15, the electric field intensity on the downstream side therefrom can be higher, which is also supported by the following theory.

(Description of the Theory)

Figure 11A:
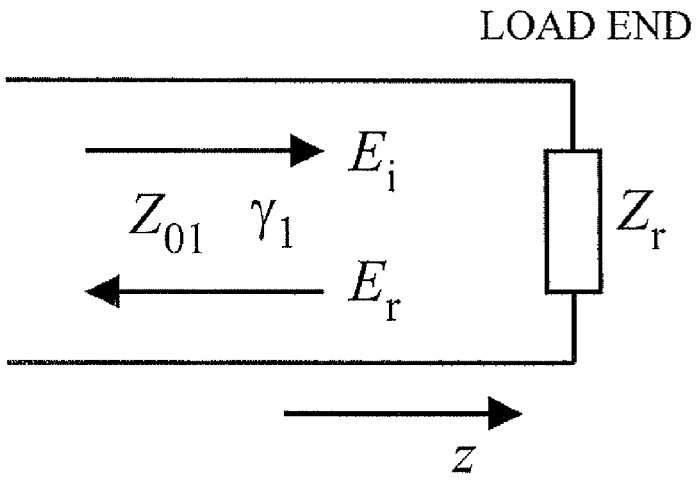
FIG. 11A is a conceptual diagram for describing each electric field state in a waveguide when a terminal section in the waveguide is short-circuited.

As shown in FIG. 11A, the load end of the rectangular waveguide is terminated with an impedance $Z_r$. When in consideration of the $TE_{10}$ mode, $E_i$ is the amplitude of an incident electric field intensity at the load end and $E_r$ is the amplitude of a reflected electric field intensity at the load end, $E_y$ and $H_x$ at points on the Z axis of the waveguide are expressed by Equation 3. The a direction in FIG. 2 corresponds to the X axis, the b direction therein corresponds to the Y axis, and the d2 direction therein corresponds to the Z axis. $E_y$ corresponds to the Y axis component of an electric field, and $H_x$ corresponds to the X axis component of a magnetic field.

$$E_y = E_i e^{-\gamma_1 z} + E_r e^{\gamma_1 z} \qquad \text{[Equation 3]}$$

$$H_x = H_i e^{-\gamma_1 z} - H_r e^{\gamma_1 z} = \frac{1}{Z_{01}}(E_i e^{-\gamma_1 z} + E_r e^{\gamma_1 z})$$

In Equation 3, $Z_{01}$ is a characteristic impedance, and $\gamma_1$ is a propagation constant.

Figure 11B:
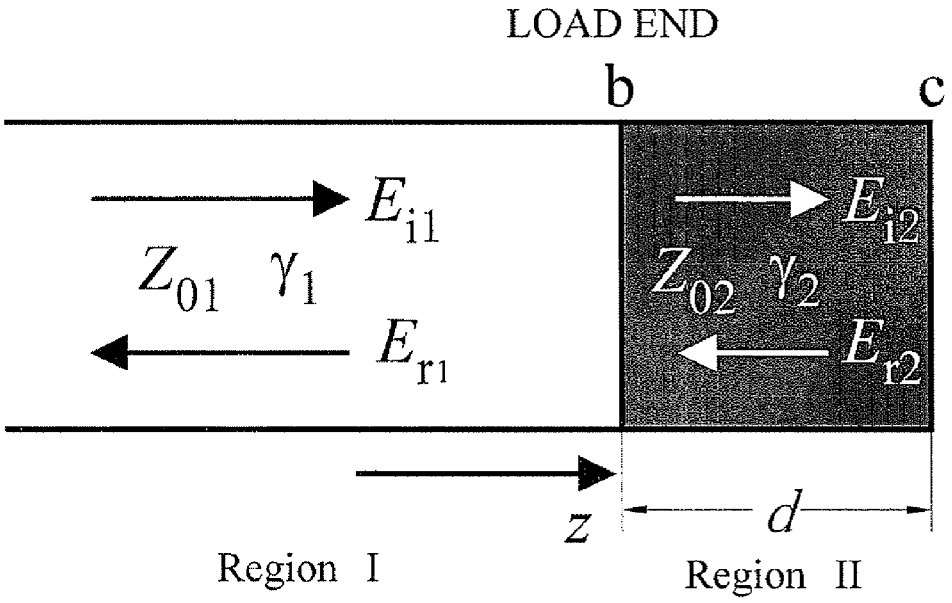
FIG. 11B is a conceptual diagram for describing an electric field state in a waveguide when a material having different permittivity is provided in a terminal section in the waveguide.

Here, as shown in FIG. 11B, a region I includes an atmosphere, and a region II is filled with the dielectric short-circuited at a terminal end c as an impedance $Z_R$. When $E_{i1}$ is the incident electric field intensity of the region I, $E_{r1}$ is the reflected electric field intensity of the region I, $E_{i2}$ is the incident electric field intensity of the region II, and $E_{r2}$ is the reflected electric field intensity of the region II, Equation 4 is established by Equation 2 and under the boundary conditions at z=0.

$$E_{i1} + E_{r1} = E_{i2} + E_{r2} \qquad \text{[Equation 4]}$$

$$H_{i1} - H_{r1} = \frac{1}{Z_{01}}(E_{i1} - E_{r1}) = \frac{1}{Z_{02}}(E_{i2} - E_{r2})$$

Here, since in FIG. 11B, the surface of terminal end c is short-circuited, Equation 5 is established. The Z coordinate in the head position (on the microwave generating side) in the region II is 0, and the width of the region II in the Z axis direction is d.

$$E_x(z=d)=E_{i2}e^{-\gamma_2 d}+E_{r2}e^{\gamma_2 d}=0 \qquad \text{[Equation 5]}$$

A equation 6 is established by solving the equation 5 for $E_{i2}$.

$$\frac{E_{i2}}{E_{i1}} = \frac{-2Z_{02}e^{-\gamma_2 d}}{Z_{02}(e^{\gamma_2 d} - e^{-\gamma_2 d}) + Z_{01}(e^{\gamma_2 d} + e^{-\gamma_2 d})} = 0 \qquad \text{[Equation 6]}$$

An equation 7 is established by ignoring a loss and obtaining its absolute value in the equation 6.

$$\left|\frac{E_{i2}}{E_{i1}}\right| = \left|\frac{E_{r2}}{E_{r1}}\right| \qquad \text{[Equation 7]}$$

$$= \left\{1 + \left[\left(\frac{\beta_{2g}}{\beta_{1g}}\right)^2 - 1\right]\cos^2(\beta_{2g}d)\right\}^{\frac{1}{2}}$$

$$= [1 + (K^2 - 1)\cos^2(\beta_{2g}d)]^{\frac{1}{2}}$$

In Equation 7, $\beta_{1g}$ is a complex component (phase constant) of a waveguide wavelength $\lambda_{1g}$ in the region I, and $\beta_{2g}$ is a complex component (phase constant) of a waveguide wavelength $\lambda_{2g}$ in the region II. In addition, K is a constant.

From Equation 7, when $\beta_{2g}d$ is an odd multiple of $\pi/2$, the electric field intensity of the region II is equal to the incident electric field intensity, and when $\beta_{2g}d$ is an even multiple of $\pi/2$, the electric field intensity of the region II is 1/K of the incident electric field intensity. When the boundary surface between the regions having different dielectric constants is at the antinode of the electric field, the electric field intensities of the regions on both sides of the boundary surface are equal. When the boundary surface between the regions having different dielectric constants is at the node of the electric field, the electric field intensities of the regions on both sides of the boundary surface are inversely proportional to the ratio between phase constants $\beta_g$ of the regions.

Figure 11C:
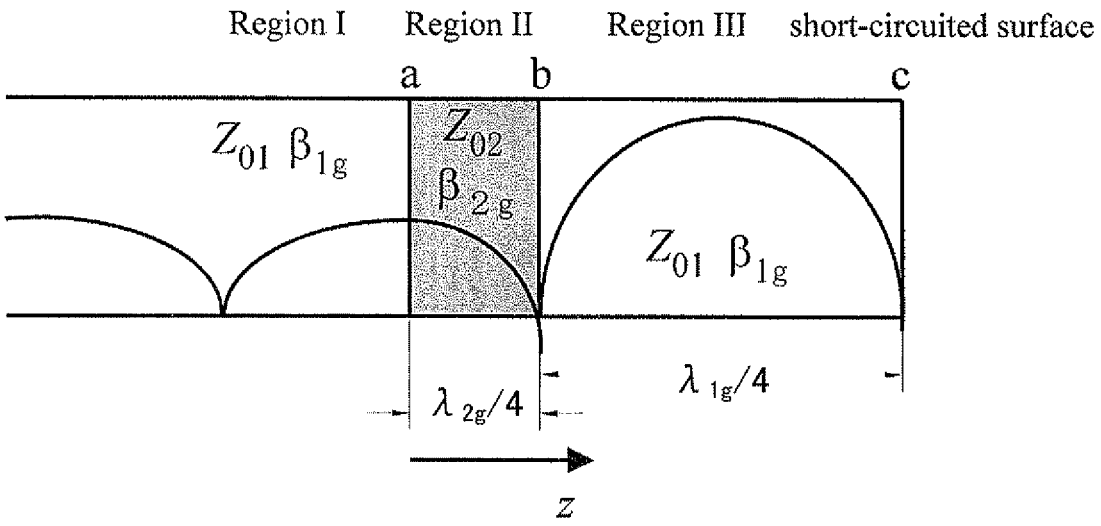
FIG. 11C is a conceptual diagram for describing an electric field state in an upstream side of a dielectric body, the dielectric body, and in a downstream side of the dielectric body when a material having different permittivity is provided in a waveguide.

Therefore, as shown in FIG. 11C, the waveguide is filled with the dielectric having a thickness of $\lambda_{2g}/4$ on the downstream side from a reference surface a (region II), and a short-circuited surface c is then placed at the distance of $\lambda_{1g}/4$ on the downstream side of the region II from b (region III). Equation 8 is thus established. $E_I$, $E_{II}$, and $E_{III}$ indicate electric field intensities in the regions I, II, and III, respectively.

$$\left|\frac{E_{III}}{E_{II}}\right| = \left|\frac{\beta_{2g}}{\beta_{1g}}\right| = K \qquad \text{[Equation 8]}$$

In consideration of the condition $|E_I|=|E_{II}|$, Equation 9 is established.

$$|E_{III}|=K|E_I| \qquad \text{[Equation 9]}$$

From Equation 9, the electric field intensity of the region III is K times the electric field intensity of the region I. That is, by interposing the dielectric having a thickness of $\lambda_{2g}/4$, that is, the electric field transformer 15, the electric field intensity on the upstream side therefrom is amplified to be propagated to the downstream side.

When the region I includes an atmosphere and the region II includes the dielectric having a dielectric constant $\in_r$, the constant K is defined by Equation 10.

$$K = \frac{\beta_{2g}}{\beta_{1g}} = \left[\frac{\varepsilon_r - \left(\frac{\lambda}{2a}\right)^2}{1 - \left(\frac{\lambda}{2a}\right)^2}\right]^{\frac{1}{2}} \quad \text{[Equation 10]}$$

COMPARISON EXAMPLE 3

Figure 12A:
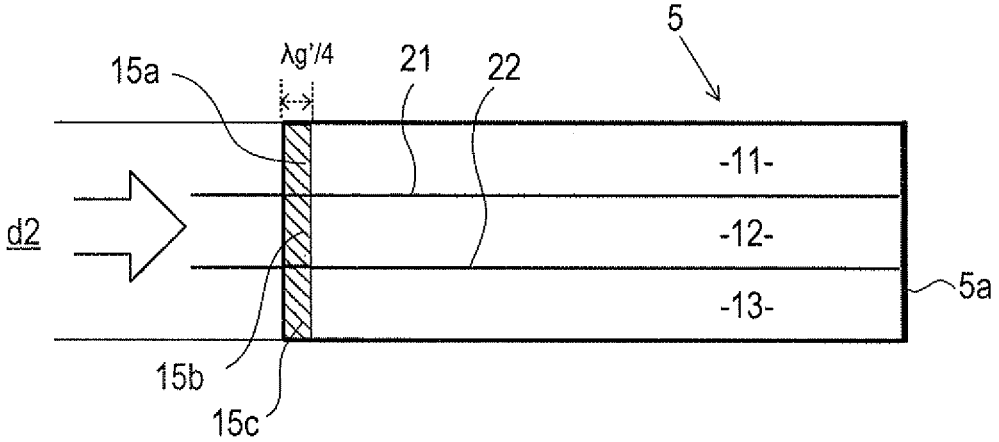
FIG. 12A is a conceptual configuration diagram in a comparison example 3.

FIG. 12A is a conceptual configuration diagram of a comparison example 3, and shows a state in which the electric field transformer 15 (15*a*, 15*b*, 15C) including ultra high molecular weight polyethylene is inserted in each of the spaces 11, 12, and 13, compared with the configuration of the comparison example 1. A width of the electric field transformer 15 is λg'/4.

Figure 12B:
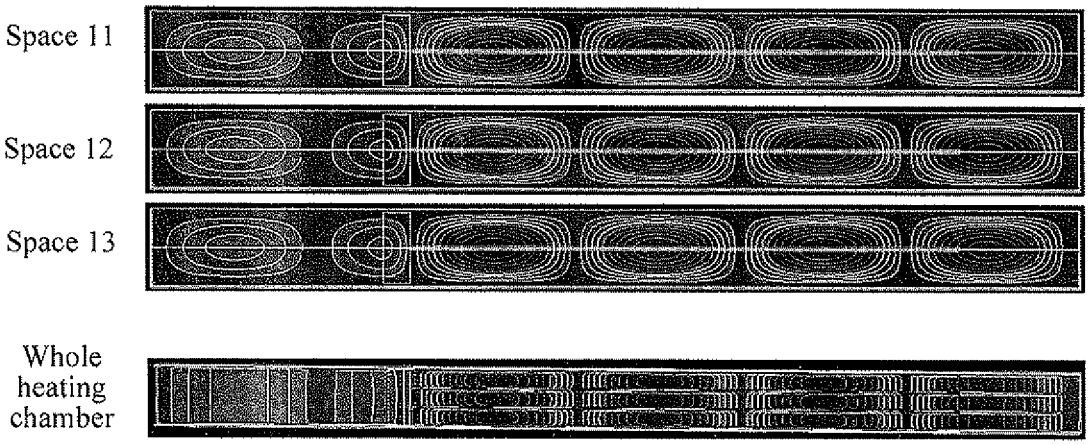
FIG. 12B is a view showing an electric field distributed state of a standing microwave in the comparison example 3 with contour lines.
Figure 12C:
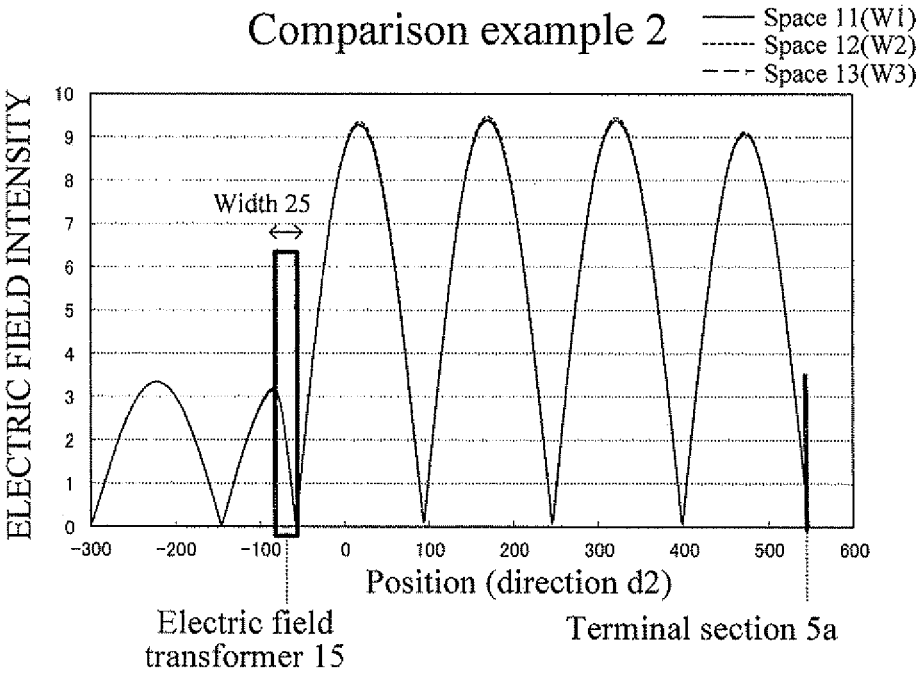
FIG. 12C is a view showing a relationship between a position and electric field intensity in the electric field distributed state of the standing microwave in the comparison example 3 with a graph.

FIGS. 12B and 12C show an electric field distribution of the standing microwaves in the respective spaces when the microwave is introduced in the direction d2 in this state. FIG. 123 is a view showing an electric field distribution state of the standing microwave in the comparison example 3 with contour lines. FIG. 12C is a view showing a relationship between a position and electric field intensity in the comparison example 3 with a graph.

When the comparison example 1 (FIG. 6C) and the comparison example 3 (FIG. 12C) are compared, it is found that the electric field intensity of the standing microwave formed in the space can be largely increased by the insertion of the electric field transformer 15. However, regarding the comparison example 3, the space is simply divided into three, similar to the comparison example 1, the phases of the standing microwaves W1, W2, and W3 formed in the spaces 11, 12, and 13, respectively are not shifted, and the positions of the bottoms of the standing microwaves are almost the same in the direction d2. Therefore, the uneven heating occurs when the heating is performed in this state.

EXAMPLE 2

Figure 13A:
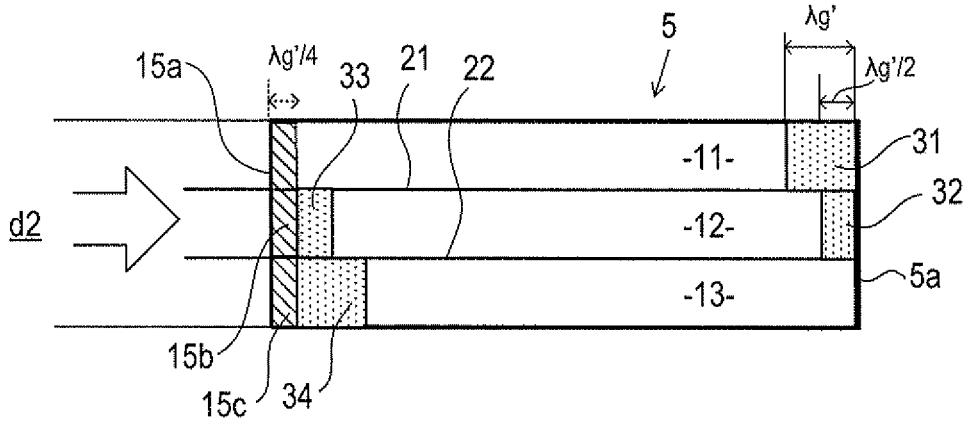
FIG. 13A is a conceptual diagram in an example 2.

FIG. 13A is a conceptual configuration diagram of an example 2, and shows a state in which the electric field transformer 15 (15*a*, 15*b*, 15C) including ultra high molecular weight polyethylene is inserted in each of the spaces 11, 12, and 13, compared with the configuration of the example 1. A width of the electric field transformer 15 is λg'/4. Here, the phase shifters 32 and 33, the impedance adjusters 33 and 34, and the electric field transformers 15*a*, 15*b*, and 15*c* are all made up of the same material, that is, ultra high molecular weight polyethylene.

Figure 13B:
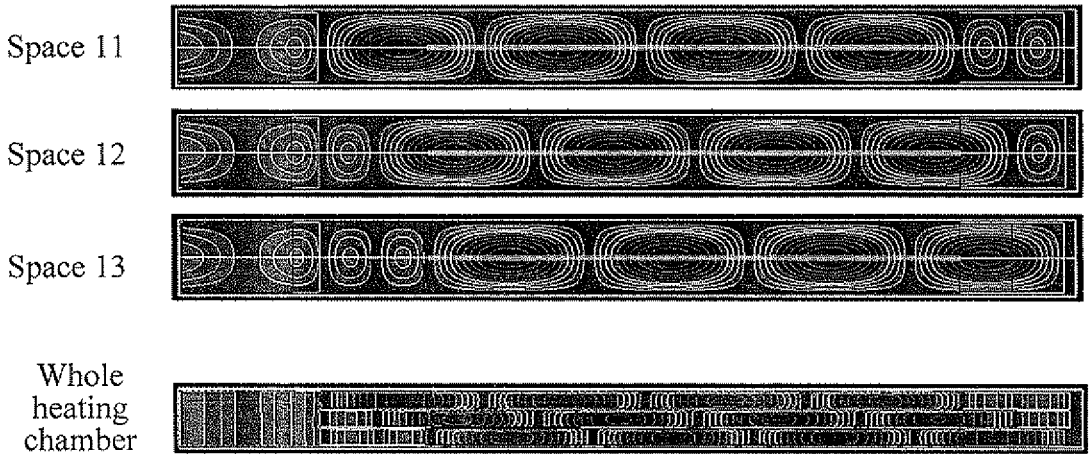
FIG. 13B is a view showing an electric field distributed state of a standing microwave in the example 2 with contour lines.
Figure 13C:
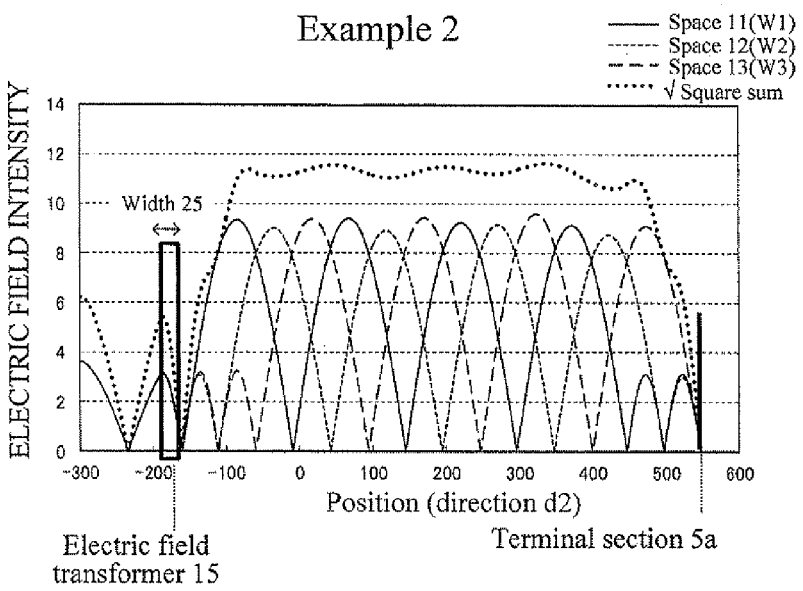
FIG. 13C is a view showing a relationship between a position and electric field intensity in the electric field distributed state of the standing microwave in the example 2 with a graph.

FIGS. 13B and 13C show an electric field distribution of the standing microwaves in the respective spaces when the microwave is introduced in the direction d2 in this state. FIG. 13B is a view showing an electric field distribution state of the standing microwave in the example 2 with contour lines. FIG. 13C is a view showing a relationship between a position and electric field intensity in the example 2 with a graph.

Referring to FIGS. 13B and 13C, similar to the example 1, it is found that each space shows almost the same electric field intensity, and the positions of the bottoms of the standing microwaves are mutually shifted in the direction d2. Thus, when the sheet 10 is passed through in this configuration in the direction d1, it can be almost uniformly heated in the direction d2.

Thus, when the example 1 (FIG. 8C) and the example 2 (FIG. 13C) are compared, it is found that the electric field intensity of the standing microwave formed in each space can be considerably increased by the insertion of the electric field transformer 15. That is, according to the example 2, the electric field intensity can be further increased while the bottoms of the standing microwaves W1, W2, and W3 formed in the spaces 11, 12, and 13, respectively, are shifted in the direction d2. Thus, compared with the example 1, heating efficiency can be further improved.

[Other Embodiments]

<1> In the above embodiment, the description has been given of the case where the heating chamber 5 is divided into the three spaces 11, 12, and 13 with the metal partition plates 21 and 22, but as long as the heating chamber 5 can be divided, the space is not always required to be divided with the "plates". That is, as another configuration, a waveguide in which a plurality of spaces have been already provided along the longitudinal direction (direction d2) may be used.

Figure 14:
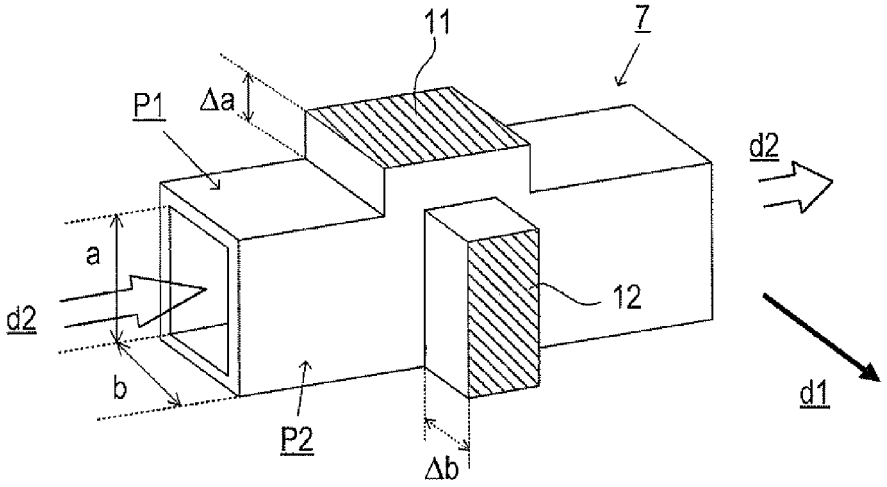
FIG. 14 is a conceptual diagram of a tuner.

<2> As the tuner 7, an E-H tuner is preferably used, for example. FIG. 14 is a conceptual configuration diagram in the case where the E-H tuner is used as the tuner 7. The tuner 7 has a configuration in which a first T-junction 11 is provided on a side face P1 parallel to the traveling direction d1 of the sheet, and a second T-junction 12 is provided on a side face P2 vertical to the directions d1 in a square tubular waveguide surrounded with a conductor such as a metal. A constituent material of the tuner 7 includes a non-magnetic metal (having almost the same magnetic permeability as magnetic permeability of vacuum) such as aluminum, copper, silver or gold, an alloy having high electric conductivity, one or multi-layered plating having a thickness which is several times as large as a surface skin depth of the above metal or alloy, foil, surface-treated (including coating with a metal material) metal, alloy such as brass, and resin.

When the tuner 7 including the E-H tuner is provided between the microwave generating portion 3 and the heating chamber 5, the power of the standing microwave formed in the heating chamber can be considerably increased. More specifically, after the incident microwave has been reflected at the terminal section 5*a* of the heating chamber 5, the reflected wave is reflected by the E-H tuner 7 toward the heating chamber 5 again. This reflection is repeated several times, so that the electric field of the standing microwave formed in the heating chamber 5 can be increased.

<3> In the above embodiment, the microwave is used for fusing toner onto the sheet. However, the present invention can be used for other typical applications in which abrupt heating is required in a short time (e.g., calcination and sintering of ceramics, chemical reaction requiring high temperature, and manufacturing of a wiring (conductive) pattern with toner as metal particles).

<4> In the second embodiment, the width of the electric field transformer 15 is preferably an odd multiple of λg'/4. However, the width of the electric field transformer 15 should satisfy at least the relational equations, and is desirably close to an odd multiple of λg'/4 where possible. When the width of the electric field transformer 15 is an even multiple of λg/4, impedance conversion is not performed. Therefore, the effect of increasing the electric field intensity on the later stage (terminal end 5*a*) side cannot be exhibited. Hereinafter, a description will be given of this point with reference to an example.

In addition, a following description will be given with reference to a case where, for convenience of simulation, the heating chamber 5 is not divided into three spaces, and a comparison is made on how much the intensity of the electric field is changed before and after the electric field transformer when the width of the electric field transformer 15 is changed, but the same phenomenon is generated even when the heating chamber 5 is divided into three spaces.

FIGS. 15A to 15F are graphs showing the electric field intensity in the heating chamber 5 when the microwave is introduced from the microwave generating portion 3 to the heating chamber 5 while the width of the electric field transformer 15 is changed, in the case where the heating chamber 5 has one space. In this example, the dielectric having the same width is interposed directly ahead of a short-circuited plate. This is performed for making the experimental conditions identical, and does not affect the effect of Examples. In addition, depending on the graphs, the magnitude of the electric field intensity in a position at the wave trough of the standing microwave is slightly varied, which is within the calculation error range.

Figure 15A:
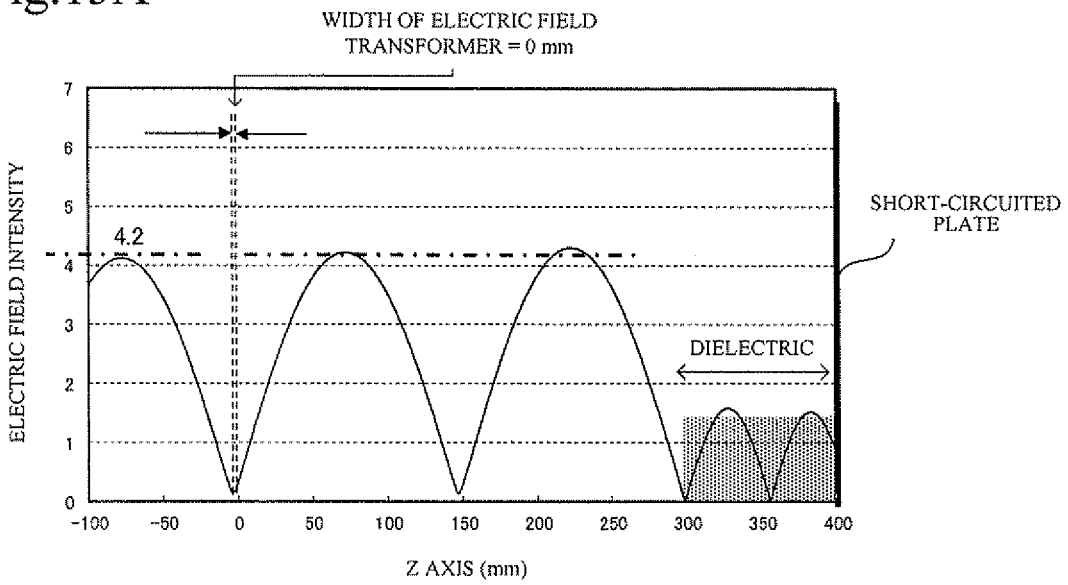
FIG. 15A is a graph showing the waveform of a standing microwave when the electric field transformer is not interposed.
Figure 15B:
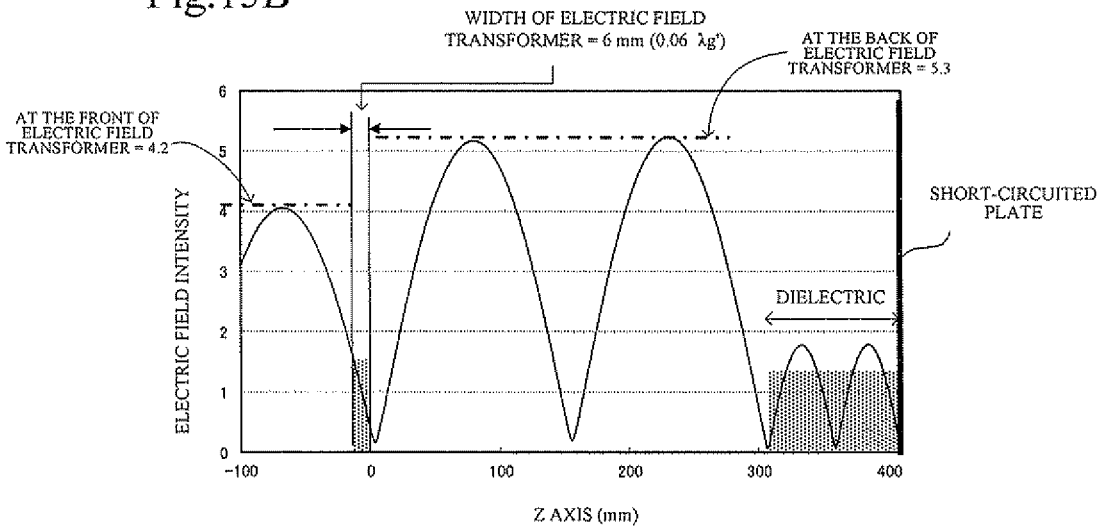
FIG. 15B is a graph showing change in electric field intensity when the electric field transformer having a width of 0.06 λg' is interposed.
Figure 15C:
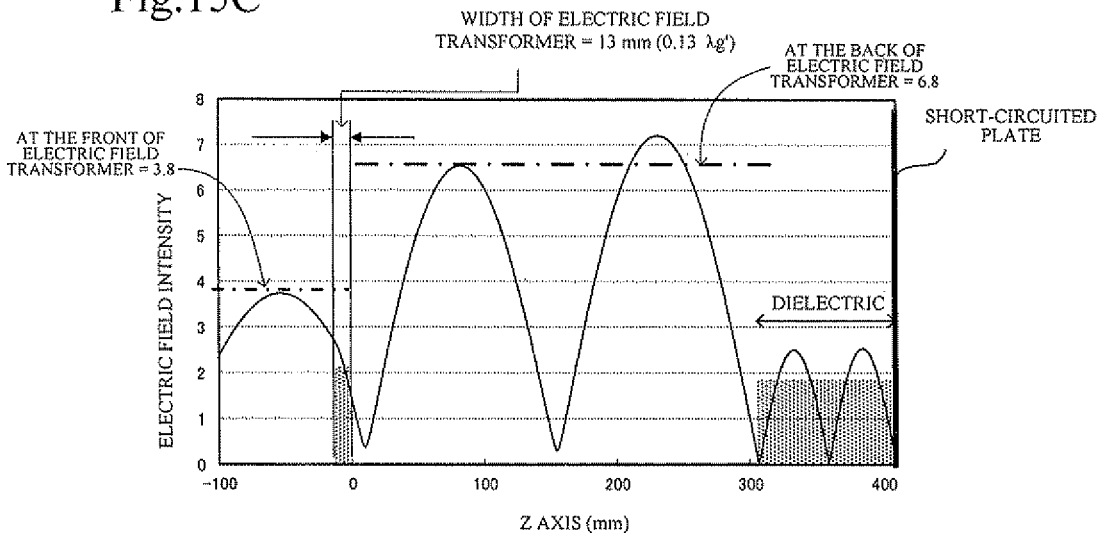
FIG. 15C is a graph showing change in electric field intensity when the electric field transformer having a width of 0.13 λg' is interposed.
Figure 15D:
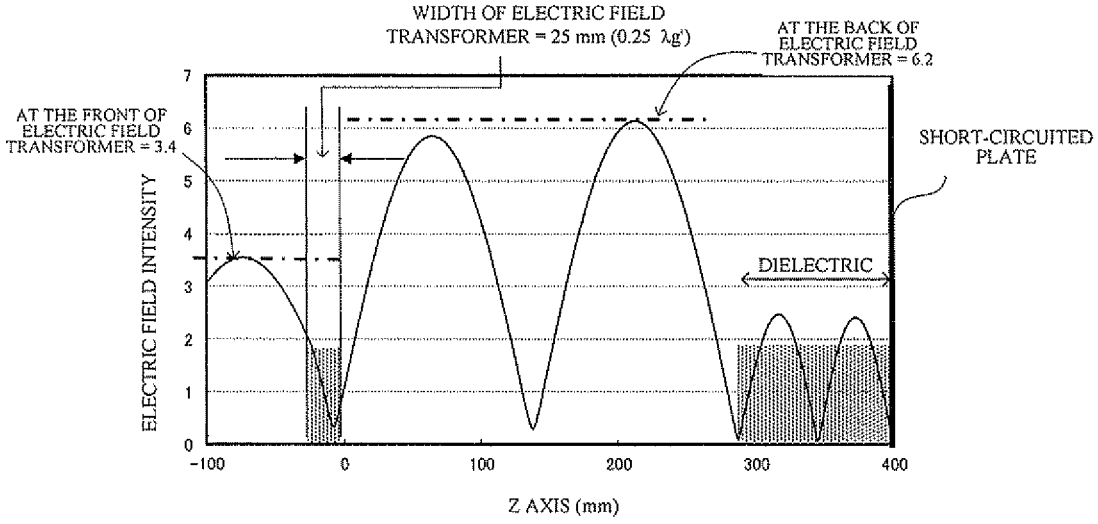
FIG. 15D is a graph showing change in electric field intensity when the electric field transformer having a width of 0.25 λg' is interposed.
Figure 15E:
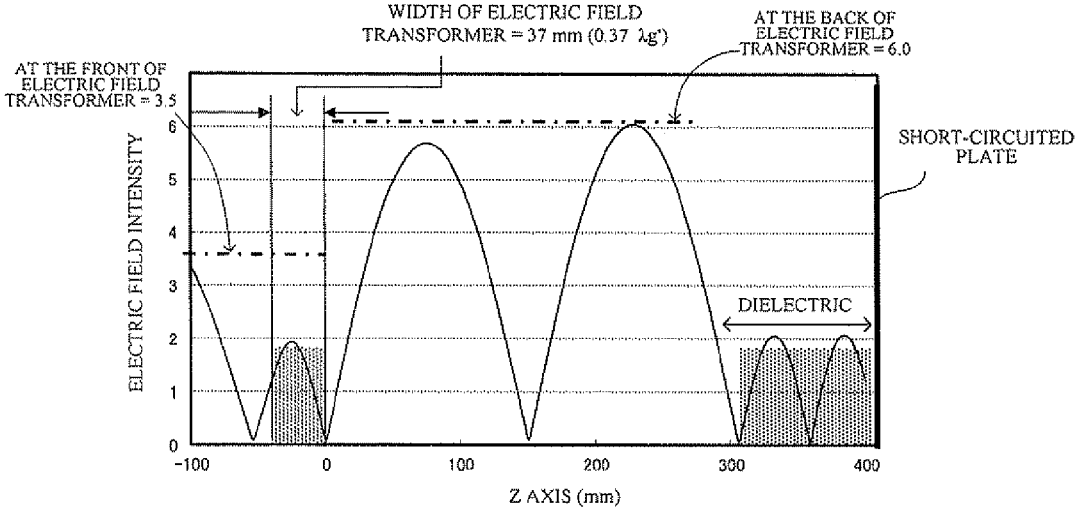
FIG. 15F is a graph showing change in electric field intensity when the electric field transformer having a width of 0.44 λg' is interposed.
FIG. 15G is a graph showing the relation between the front-to-back ratio of the electric field transformer and the width of the electric field transformer.
FIG. 15H is a table showing the relation between the front-to-back ratio of the electric field transformer and the width of the electric field transformer.
Figure 15F:
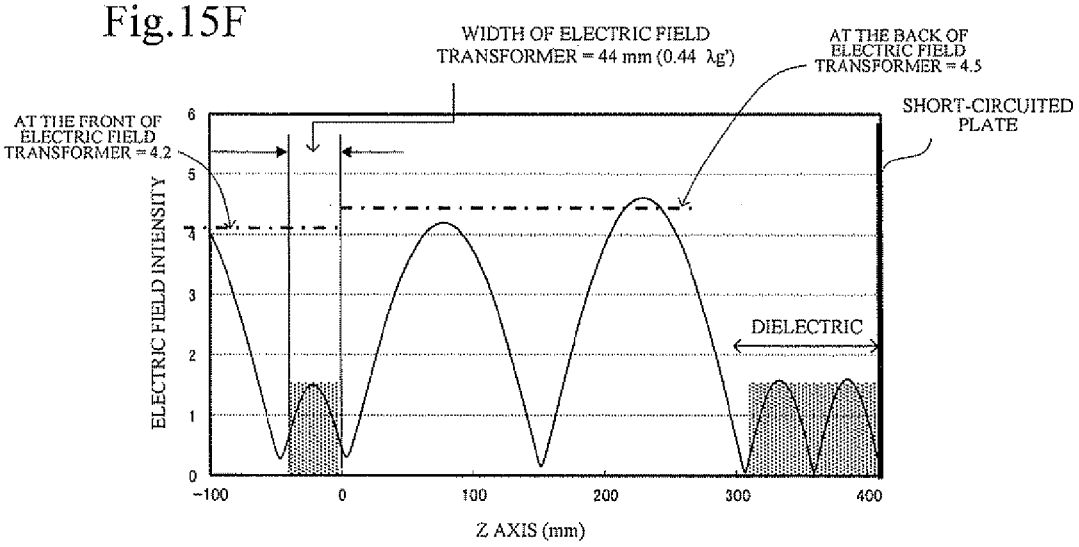
Figures 15G, 15H:
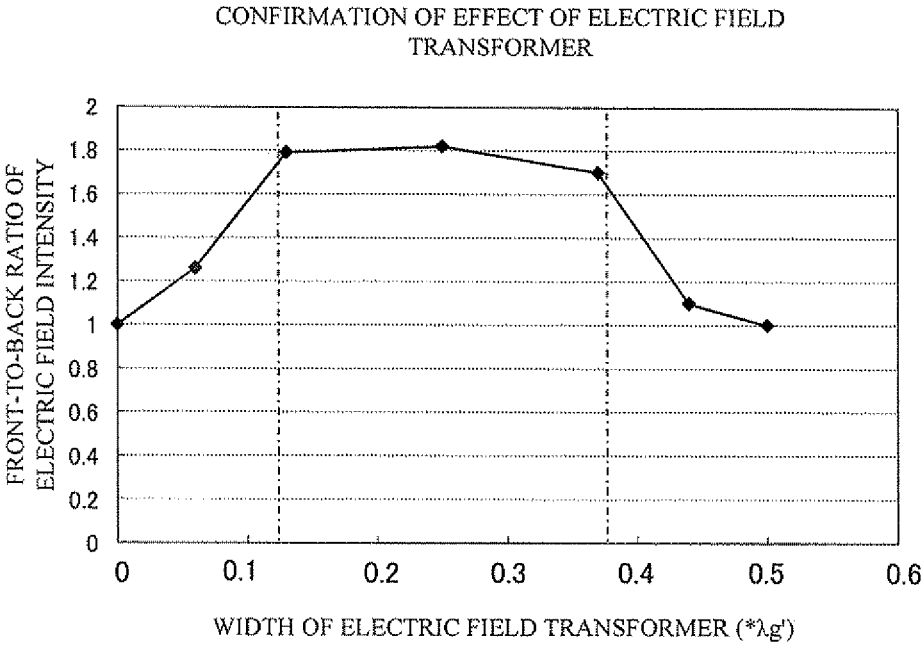

FIG. 15G is a graph showing change in the ratio between the magnitudes of electric field intensities on the upstream side and the downstream side of the electric field transformer 15 when the width of the electric field transformer 15 is changed. FIG. 15H is a table thereof.

FIGS. 15A, 15B, 15C, 15D, 15E, and 15F are graphs made when the widths of the electric field transformer 15 are 0, 6 mm, 13 mm, 25 mm, 37 mm, and 44 mm, respectively.

In FIG. 15A, since the electric field transformer 15 is not interposed, as a matter of course, the electric field intensity is not changed at the front and back of the electric field transformer 15 (electric field intensity=4.2).

In FIG. 15B, the width of the electric field transformer 15 is 6 mm (this corresponds to 0.06 λg'). On the upstream side of the electric field transformer 15, the electric field intensity=4.2. On the downstream side of the electric field transformer 15, the electric field intensity=5.3. The electric field intensity is 1.26 times higher at the back than at the front of the electric field transformer 15.

In FIG. 15C, the width of the electric field transformer 15 is 13 mm (this corresponds to 0.13 λg'). On the upstream side of the electric field transformer 15, the electric field intensity=3.8. On the downstream side of the electric field transformer 15, the electric field intensity=6.8. The electric field intensity is 1.79 times higher at the back than at the front of the electric field transformer 15.

In FIG. 15D, the width of the electric field transformer 15 is 25 mm (this corresponds to 0.25 λg'). On the upstream side of the electric field transformer 15, the electric field intensity=3.4. On the downstream side of the electric field transformer 15, the electric field intensity=6.2. The electric field intensity is 1.82 times higher at the back than at the front of the electric field transformer 15.

In FIG. 15E, the width of the electric field transformer 15 is 37 mm (this corresponds to 0.37 λg'). On the upstream side of the electric field transformer 15, the electric field intensity=3.5. On the downstream side of the electric field transformer 15, the electric field intensity=6.0. The electric field intensity is 1.7 times higher at the back than at the front of the electric field transformer 15.

In FIG. 15F, the width of the electric field transformer 15 is 44 mm (this corresponds to 0.44 λg'). On the upstream side of the electric field transformer 15, the electric field intensity=4.2. On the downstream side of the electric field transformer 15, the electric field intensity=4.5. The electric field intensity is 1.1 times higher at the back than at the front of the electric field transformer 15.

Although not shown on the graphs, when the width of the electric field transformer 15 is 50 mm (this corresponds to 0.50 λg'), the upstream end point and the downstream end point of the electric field transformer 15 are both in the position at the wave trough of the standing microwave. Therefore, the electric field intensity is not changed on the downstream side and the upstream side of the electric field transformer 15.

According to the above results, a width L of the electric field transformer 15 is set to satisfy $(4N-3)\lambda g'/8<L<(4N-1)\lambda g'/8$ by using the relational equations, that is, natural number N, so that the electric field intensity of the standing microwave on the downstream side of the electric field transformer 15 can be higher. Accordingly, the electric field intensity in the heating chamber 5 can be higher to greatly shorten time necessary for toner fusion.

Even when the heating chamber 5 is divided into three spaces, the above relationship can be established in the respective spaces, so that the similar discussion can be provided. In this case again, when the electric field transformer 15 includes the material different from that of the phase shifters 31 and 32, the relational expression provided by replacing λg' with λgz (wavelength of the standing microwave in the electric field transformer 15) in the above relational expression is employed.

<5> According to the second embodiment, the electric field transformer 15 is inserted into each of the spaces 11, 12, and 13 in the region having the three spaces. However, there is a case where, as another configuration, the space in the vicinity of the entrance of the heating chamber 5 is not divided, and three spaces are formed by providing the partition plates 21 and 22 at a predetermined distance from the entrance to the downstream side. In this configuration, the electric field transformer 15 may be inserted in a predetermined region from the entrance which is not divided to the three spaces to the distance D in the direction d2.

<6> According to the above embodiment, the phases are shifted by providing one space in which the phase shifter is not inserted, but the phases may be shifted by providing the phase shifters for all of the spaces. In addition, similarly, the impedance is adjusted by providing the one space in which the impedance adjuster is not inserted, but the impedance may be adjusted by providing the impedance adjusters for all of the spaces.

What is claimed is:

1. A microwave heating device comprising:

a microwave generating portion outputting a microwave; and a conductive heating chamber into which the microwave is led and having a short-circuited terminal end in a traveling direction of the microwave, wherein the heating chamber is divided into a plurality of spaces until a position of the terminal section along the traveling direction by a barrier section including a conductive material, and has an opening provided so that an object to be heated passes through the heating chamber in a direction non-parallel to the traveling direction of the microwave, phase shifters having different lengths with respect to the traveling direction and including a dielectric body having permittivity higher than air are inserted in the positions of the terminal sections toward the microwave generating portion, in the spaces except for one of the plurality of spaces, to mutually differentiate positions of bottoms of standing microwaves formed in the respective spaces with respect to the traveling direction, impedance adjusters having different lengths with respect to the traveling direction and including a dielectric body having permittivity higher than air are inserted in positions on an upstream side of a region passed by the object to be heated, in the spaces except for at least one of the plurality of spaces, to reduce differences in impedance in the spaces from an entrance of the heating chamber for receiving the microwave to the terminal section, including the phase shifter, and a square tubular waveguide including a conductive material makes a connection between a microwave output end of the microwave generating portion and the terminal section of the heating chamber, except for apart of the opening provided for passing the object to be heated, wherein positions of the bottoms of the standing microwaves formed in the respective spaces are mutually shifted by λg/(2N) in the traveling direction, in which N (N is 2 or more natural number) represents the number of the spaces, and λg represents an internal wavelength of the standing microwave formed in the waveguide of the heating chamber.

2. The microwave heating device according to claim 1, wherein a length of the phase shifter inserted into the space with respect to the traveling direction is defined by an integral multiple of λg'/2, in which λg' represents an internal wavelength of a standing microwave formed in the dielectric body of the phase shifter.

3. The microwave heating device according to claim 1, wherein the phase shifter and the impedance adjuster comprise the same material, and a total value of lengths of the phase shifter and the impedance adjuster in the space from the entrance of the heating chamber to the terminal section with respect to the traveling direction is equal to each other.

4. The microwave heating device according to claim 3, wherein the phase shifter and the impedance adjuster are made of ultra high molecular weight polyethylene.

5. The microwave heating device according to claim 1, comprising an electric field transformer including a dielectric body having permittivity higher than air in the space, wherein the electric field transformer has a length larger than (4N−3) λgz/8 but smaller than (4N−1) λgz/8 with respect to the traveling direction, in which λgz represents an internal wavelength of a standing microwave formed in a dielectric body of the electric field transformer, and N (N>0) represents a natural number, is provided on a side closer to the microwave generating portion than the insertion position of the impedance adjuster with respect to the traveling direction so as to include the bottom of the standing microwave.

6. The microwave heating device according to claim 5, wherein the electric field transformer is set in such a manner that a width of the electric field transformer is an odd multiple of ¼ λgz and a face of a side of the terminal section of the heating chamber is positioned in the bottom of the standing microwave.

7. The microwave heating device according to claim 6, wherein the electric field transformer comprises the same material as that of the phase shifter and the impedance adjuster.

8. The microwave heating device according to claim 7, wherein each of the electric field transformer, the phase shifter, and the impedance adjuster is made of ultra high molecular weight polyethylene.

9. An image fixing apparatus comprising:

the microwave heating device according to claims 1, wherein a recording sheet with developing particles passes through the opening and is heated in the heating chamber, thereby fusing the developing particles onto the recording sheet.

10. A microwave heating device comprising:

a microwave generating portion outputting a microwave;

a conductive heating chamber into which the microwave is led and having a short-circuited terminal end in a traveling direction of the microwave;

a plurality of spaces into that the heating chamber is divided until a position of the terminal section along the traveling direction by a barrier section including a conductive material;

an opening that is provided on the heating chamber so that an object to be heated passes through the heating chamber in a direction non-parallel to the traveling direction of the microwave;

phase shifters having different lengths with respect to the traveling direction and including a dielectric body having permittivity higher than air are inserted in the positions of the terminal sections toward the microwave generating portion, in the spaces except for one of the plurality of spaces, to mutually differentiate positions of bottoms of standing microwaves formed in the respective spaces with respect to the traveling direction;

impedance adjusters having different lengths with respect to the traveling direction and including a dielectric body having permittivity higher than air are inserted in positions on an upstream side of a region passed by the object to be heated, in the spaces except for at least one of the plurality of spaces, to reduce differences in impedance in the spaces from an entrance of the heating chamber for receiving the microwave to the terminal section, including the phase shifter, and a square tubular waveguide including a conductive material makes a connection between a microwave output end of the microwave generating portion and the terminal section of the heating chamber, except for apart of the opening provided for passing the object to be heated, wherein positions of the bottoms of the standing microwaves formed in the respective spaces are mutually shifted by λg/(2N) in the traveling direction, in which N (N is 2 or more natural number) represents the number of the spaces, and λg represents an internal wavelength of the standing microwave formed in the waveguide of the heating chamber.

11. The microwave heating device according to claim 10, wherein a length of the phase shifter inserted into the space with respect to the traveling direction is defined by an integral multiple of λg'/2, in which λg' represents an internal wavelength of a standing microwave formed in the dielectric body of the phase shifter.

12. The microwave heating device according to claim 10, wherein the phase shifter and the impedance adjuster comprise the same material, and a total value of lengths of the phase shifter and the impedance adjuster in the space from the entrance of the heating chamber to the terminal section with respect to the traveling direction is equal to each other.

13. The microwave heating device according to claim 12, further comprising:

an ultra high molecular weight polyethylene applied to the phase shifter and the impedance adjuster.

14. The microwave heating device according to claim 10, further comprising;

an electric field transformer including a dielectric body having permittivity higher than air in the space and having a length larger than (4N−3) λgz/8 but smaller than (4N−1) λgz/8 with respect to the traveling direction, in which λgz represents an internal wavelength of a standing microwave formed in a dielectric body of the electric field transformer, and N (N>0) represents a natural number, is provided on a side closer to the microwave generating portion than the insertion position of the impedance adjuster with respect to the traveling direction so as to include the bottom of the standing microwave.

15. The microwave heating device according to claim 14, wherein the electric field transformer is set in such a manner that a width of the electric field transformer is an odd multiple of ¼ λgz and a face of a side of the terminal section of the heating chamber is positioned in the bottom of the standing microwave.

16. The microwave heating device according to claim 15, wherein the electric field transformer comprises the same material as that of the phase shifter and the impedance adjuster.

17. The microwave heating device according to claim 10, further comprising;

an electric field transformer made of ultra high molecular weight polyethylene and having a length larger than (4N−3) λgz/8 but smaller than (4N−1) λz/8 with respect to the traveling direction, in which λgz represents an internal wavelength of a standing microwave formed in a dielectric body of the electric field transformer, and N (N>0) represents a natural number, is provided on a side closer to the microwave generating portion than the insertion position of the impedance adjuster with respect to the traveling direction so as to include the bottom of the standing microwave.

18. An image fixing apparatus comprising:

the microwave heating device according to claims 10, wherein a recording sheet with developing particles passes through the opening and is heated in the heating chamber, thereby fusing the developing particles onto the recording sheet.

* * * * *